US011971037B2

(12) United States Patent
Kumakura et al.

(10) Patent No.: US 11,971,037 B2
(45) Date of Patent: Apr. 30, 2024

(54) DRIVE SHAFT OF COMPRESSOR HAVING OIL GROOVE PORTION AND OIL SUMP

(71) Applicant: DAIKIN INDUSTRIES, LTD., Osaka (JP)

(72) Inventors: Eiji Kumakura, Osaka (JP); Kazuhiro Furusho, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/883,918

(22) Filed: Aug. 9, 2022

(65) Prior Publication Data

US 2022/0381245 A1 Dec. 1, 2022

Related U.S. Application Data

(62) Division of application No. 16/480,223, filed as application No. PCT/JP2018/001541 on Jan. 19, 2018, now abandoned.

(30) Foreign Application Priority Data

Jan. 30, 2017 (JP) ..... 2017-014219

(51) Int. Cl.

| | |
|---|---|
| ***F04C 29/04*** | (2006.01) |
| ***F04C 18/02*** | (2006.01) |
| ***F04C 18/18*** | (2006.01) |
| ***F04C 29/00*** | (2006.01) |
| ***F04C 29/02*** | (2006.01) |

(52) U.S. Cl.

CPC ..... *F04C 29/04* (2013.01); *F04C 18/0215* (2013.01); *F04C 29/0057* (2013.01); *F04C 29/023* (2013.01); *F04C 29/028* (2013.01); *F04C 2210/26* (2013.01); *F04C 2240/40* (2013.01); *F04C 2240/50* (2013.01); *F04C 2240/60* (2013.01); *F04C 2240/603* (2013.01)

(58) Field of Classification Search

CPC ..... F04C 18/0215; F04C 29/0057; F04C 29/023; F04C 2240/60; F04C 2240/603

See application file for complete search history.

(56) References Cited

U.S. PATENT DOCUMENTS 9,850,904 B2 * 12/2017 Toyama ..... F04C 29/0057
10,451,067 B2 10/2019 Zhou et al.
(Continued)

FOREIGN PATENT DOCUMENTS

CN 103827497 A 5/2014
CN 106029852 A 10/2016
(Continued)

OTHER PUBLICATIONS

English copy of WO-2015114783 by PE2E, Jan. 24, 2023.*
International Search Report for PCT/JP2018/001541 (PCT/ISA/210) dated Apr. 10, 2018, with English translation.

*Primary Examiner* — Deming Wan
(74) *Attorney, Agent, or Firm* — Birch, Stewart, Kolasch & Birch, LLP

(57) ABSTRACT

In a compressor compressing a refrigerant including hydrocarbon fluoride prone to disproportionate, provided, on a contact portion of the drive shaft and the bearing portion, is an elastic bearing portion as a heat generation suppression portion suppressing excessive heat generation due to line contact of an end edge portion of the bearing portion with the drive shaft during rotation of the drive shaft.

6 Claims, 18 Drawing Sheets

(56) References Cited

U.S. PATENT DOCUMENTS

| | | | | |
|---|---|---|---|---|
| 2008/0240954 | A1 | 10/2008 | Morozumi et al. | |
| 2011/0067434 | A1 | 3/2011 | Miura et al. | |
| 2014/0017108 | A1* | 1/2014 | Uekawa | F04C 29/028 418/55.1 |
| 2014/0070132 | A1 | 3/2014 | Fukushima | |
| 2014/0219833 | A1 | 8/2014 | Kanayama et al. | |
| 2014/0227116 | A1 | 8/2014 | Kanayama et al. | |
| 2014/0234147 | A1 | 8/2014 | Tomioka et al. | |
| 2015/0078933 | A1 | 3/2015 | Takashima et al. | |
| 2016/0333245 | A1 | 11/2016 | Fujii et al. | |
| 2018/0066873 | A1 | 3/2018 | Maeyama | |

FOREIGN PATENT DOCUMENTS

| | | | | |
|---|---|---|---|---|
| JP | 2-34784 | U | 3/1990 | |
| JP | 2010-031785 | A | 2/2010 | |
| JP | 2011-179453 | A | 9/2011 | |
| JP | 2013-47513 | A | 3/2013 | |
| JP | 2013-068194 | A | 4/2013 | |
| JP | 2015-169089 | A | 9/2015 | |
| JP | 2015-215127 | A | 12/2015 | |
| JP | 2016-17481 | A | 2/2016 | |
| WO | WO 2010/042781 | A2 | 4/2010 | |
| WO | WO 2012/157764 | A1 | 11/2012 | |
| WO | WO 2015/125876 | A1 | 8/2015 | |
| WO | WO-2015114783 | A1 * | 8/2015 | F04B 39/02 |
| WO | WO 2015/136707 | A1 | 9/2015 | |
| WO | WO 2016/189698 | A1 | 12/2016 | |

* cited by examiner

DRIVE SHAFT OF COMPRESSOR HAVING OIL GROOVE PORTION AND OIL SUMP

CROSS REFERENCE TO RELATED APPLICATIONS

This application is a Divisional of co-pending U.S. patent application Ser. No. 16/480,223, filed on Jul. 23, 2019, which is a National Phase of PCT International Application No. PCT/JP2018/001541, filed on Jan. 19, 2018, which claims the benefit of Patent Application No. JP 2017-014219 filed in Japan, on Jan. 30, 2017. The entire contents of which are hereby incorporated by reference.

TECHNICAL FIELD

The present disclosure relates to a compressor and, in particular, a configuration in a compressor compressing a refrigerant including hydrocarbon fluoride prone to disproportionation where heat generation is suppressed to prevent disproportional reaction.

BACKGROUND ART

Conventionally, there has been known a refrigeration apparatus including a refrigerant circuit to which a compressor is connected and which performs a refrigeration cycle. Such refrigeration apparatus has been widely applied to an air-conditioning device etc. The above compressor performs a compression phase of a refrigeration cycle. Various types of such a compressor are known. Examples thereof include a rolling piston type compressor, a swing piston type compressor, and a scroll type compressor etc. For example, Patent Document 1 discloses a rolling piston type compressor.

As disclosed in Patent Document 2 (WO 2012157764), HFO-1123 and a refrigerant mixture including HFO-1123 may be applied as a refrigerant in the above refrigerant circuit and as a candidate for a low GWP refrigerant. HFO-1123 is a refrigerant including hydrocarbon fluoride prone to disproportionation (self-decomposition) in accordance with generation of compounds upon exerting any energy under a high pressure and at a high temperature, as FIG. 19 shows the reaction tendencies of two types of refrigerants (refrigerant A, refrigerant B). That is, the disproportional reaction is a chemical reaction where molecules of the same type react with each other, generating a different product.

CITATION LIST

Patent Documents

[Patent Document 1] Japanese Unexamined Patent Publication No. 2015-169089

[Patent Document 2] PCT International Publication No. WO 2012157764

SUMMARY OF THE INVENTION

Technical Problem

In case where a compressor using a refrigerant prone to disproportionation is operated under a high load or at a high rotating speed, when a partial contact occurs in a bearing structure composed of a drive shaft (S) and a bearing (B) as shown in FIG. 20, thereby causing resulting rapid local temperature rise, the disproportional reaction (self-decomposition) of the above refrigerant occurs in accordance with generation of compounds. The resulting chain reaction causes rapid temperature rise and rapid pressure rise. As a result, there may be a case where pipes are broken and a refrigerant and compounds are ejected out of the compressor. In particular, in a high-pressure dome compressor having a casing an interior of which undergoes high pressure, the refrigerant in the casing is subject to a high temperature and a high pressure. Due to further rise in temperature and in pressure, the above mentioned problem is likely to arise.

Further, when a compressor using a refrigerant prone to disproportionation has been stopped for a long time, lubricant drops down in the bearing. As a result, a shaft and the bearing are likely to come in contact with each other in their metal parts at the time of restart of the compressor. Hence, there is a growing fear that the disproportional reaction occurs.

The present disclosure has been made in view of the above problems, and it is an object of the present disclosure to provide a compressor compressing a refrigerant including hydrocarbon fluoride prone to disproportionation in which generation of a partial contact at a bearing is prevented and rise in temperature of the refrigerant is suppressed, thereby suppressing the disproportional reaction of the refrigerant.

Solution to the Problem

A first aspect of the present disclosure is set a compressor as a premise. The compressor compresses a refrigerant including hydrocarbon fluoride prone to disproportionation, and comprises: a casing (11); a compression mechanism (12) housed in the casing (11); an electric motor (13) driving the compression mechanism (12); a drive shaft (S) connecting the compression mechanism (12) with the electric motor (13); and a bearing portion (B) rotatably supporting the drive shaft (S).

The compressor includes, on a contact portion of the drive shaft (S) and the bearing portion (B), a heat generation suppression portion (1) suppressing excessive heat generation due to line contact of an end edge portion of the bearing portion (B) with the drive shaft (S) during rotation of the drive shaft (S).

According to the first aspect, since the heat generation suppression portion (1) is provided at the contact portion of the drive shaft (S) and the bearing portion (B), when the compressor is operated under a high load or at a high rpm, it is possible to prevent a partial contact of the bearing portion and resulting rapid local temperature rise Therefore, the disproportional reaction of the refrigerant is less likely to occur in the compressor using refrigerant prone to disproportionation. Further, even when lubricant drops down in the bearing in the compressor which has been stopped for a long time, it is possible to prevent the disproportional reaction at the time of restart of the compressor.

In a second aspect of the first aspect according to the present disclosure, the end edge portion of the bearing portion (B) is provided with an elastic bearing portion (2) formed to be elastic due to thin structure in that an outer diameter of the elastic bearing portion (2) is smaller than that of a main body portion except for the end edge portion, and the heat generation suppression portion (1) is made of the elastic bearing portion (2).

According to the second aspect, the elastic bearing portion (2) is provided as the heat generation suppression portion (1). Accordingly, when the compressor is operated under a high load or at a high rpm, it is possible to prevent the occurrence of a partial contact in the bearing and thus resulting rapid local temperature rise. Therefore, it is possible to prevent disproportional reaction of the refrigerant in the compressor using refrigerant prone to disproportionation.

In a third aspect of the first aspect according to the present disclosure, the drive shaft (S) includes, on an engagement portion engaging with the bearing portion (B), a shaft side crowning portion (3) with an outer diameter thereof decreasing in direction from a center portion toward an end edge portion of the engagement portion, and the heat generation suppression portion (1) is made of the shaft side crowning portion (3).

In a fourth aspect of the first aspect according to the present disclosure, the bearing portion (B) includes, on an engagement portion engaging with the drive shaft (S), a bearing side crowning portion (4) with an inner diameter thereof increasing in direction from a center portion toward an end edge portion of the engagement portion, and the heat generation suppression portion (1) is made of the bearing side crowning portion (4).

According to the third aspect, the shaft side crowning portion (3) is provided as the heat generation suppression portion (1), and according to the fourth aspect, the bearing side crowning portion (4) is provided as the heat generation suppression portion (1). Therefore, when a compressor is operated under a high load or at a high rpm, it is possible to prevent the occurrence of a partial contact in the bearing and thus resulting rapid local rise in temperature. Hence, it is possible to prevent disproportional reaction of the refrigerant in the compressor using refrigerant prone to disproportionation.

In a fifth aspect of the first aspect according to the present disclosure, the end edge portion of the bearing portion (B) is provided with a bearing side oil groove portion (5) with its inner diameter larger than a main body portion except for the end edge portion to store lubricant; the heat generation suppression portion (1) is made of the bearing side oil groove portion (5).

In a sixth aspect of the first aspect according to the present disclosure, the drive shaft (S) is provided with, on a part of an engagement portion engaging with the bearing portion (B), a shaft side oil groove portion (6) configured to store lubricant, and the heat generation suppression portion (1) is made of the shaft side oil groove portion (6). For example, the shaft side oil groove portion (6) may be provided, on a part of the engagement portion of the drive shaft (S) with the bearing portion (B) to have an outer diameter smaller than that of the main body portion except for the above part so as to store oil.

According to the fifth aspect, the bearing side oil groove portion (5) is provided as the heat generation suppression portion (1), and according to the sixth aspect, the shaft side oil groove portion (6) is provided as the heat generation suppression portion (1). In each case, when a compressor is operated under a high load or at a high rpm, providing oil coating makes it possible to prevent the occurrence of a partial contact in the bearing and thus resulting rapid local rise in temperature. Therefore, it is possible to prevent disproportional reaction of the refrigerant in the compressor using refrigerant prone to disproportionation.

In a seventh aspect of any one of the first to sixth aspects of the present disclosure, the refrigerant is a refrigerant comprising HFO-1123.

In the seventh aspect, a refrigerant including HFO-1123 is used as the refrigerant. HFO-1123 is easily decomposed by OH radicals in the atmosphere. Therefore, HFO-1123 less affects the ozone layer and global warming. Further, the use of the refrigerant including HFO-1123 makes it possible to improve the refrigeration cycle performance of a refrigeration apparatus.

Advantages of the Invention

According to the first aspect, since the heat generation suppression portion (1) is provided at a contact portion of the drive shaft (S) and the bearing portion (B), when the compressor is operated under a high load or at a high rpm, it is possible to prevent a partial contact of the bearing portion and resulting rapid local rise in temperature. As a result, in the compressor using refrigerant prone to disproportionation, it is possible to suppress a partial contact of the bearing and resulting rise in temperature of the refrigerant, thereby preventing the disproportional reaction of the refrigerant. Further, even when lubricant drops down in the bearing in the compressor which has been stopped for a long time, it is possible to prevent the disproportional reaction at the time of restart of the compressor. According to the first aspect, the above effects can be obtained also in a high-pressure dome type compressor where high pressure prevails in the casing.

According to the second aspect, the elastic bearing portion (2) is provided as the heat generation suppression portion (1). Therefore, when a compressor is operated under a high load or at a high rpm, it is possible to prevent the occurrence of a partial contact in the bearing and thus resulting rapid local temperature rise. Hence, it is possible to prevent disproportional reaction of the refrigerant with a simple configuration in a compressor using the refrigerant prone to disproportionation.

According to the third aspect, the shaft side crowning portion (3) is provided as the heat generation suppression portion (1), and according to the fourth aspect, the bearing side crowning portion (4) is provided as the heat generation suppression portion (1). Accordingly, in each case, when a compressor is operated under a high load or at a high rpm, it is possible to prevent the occurrence of a partial contact in the bearing and thus resulting rapid local temperature rise. Therefore, it is possible to prevent disproportional reaction of the refrigerant with a simple configuration in a compressor using the refrigerant prone to disproportionation.

According to the fifth aspect, the bearing side oil groove portion (5) is provided as the heat generation suppression portion (1), and according to the sixth aspect, the shaft side oil groove portion (6) is provided as the heat generation suppression portion (1). Accordingly, in each case, when a compressor is operated under a high load or at a high rpm, providing an oil coating makes it possible to prevent the occurrence of a partial contact in the bearing and thus resulting rapid local temperature rise. Therefore, it is possible to prevent disproportional reaction of the refrigerant with a simple configuration in a compressor using the refrigerant prone to disproportionation.

According to the seventh aspect, a refrigerant including HFO-1123 is used as the refrigerant. HFO-1123 is easily decomposed by OH radicals in the atmosphere. Therefore, HFO-1123 less affects the ozone layer and global warming. Further, the use of the refrigerant including HFO-1123 makes it possible to improve the refrigeration cycle performance of a refrigeration apparatus. Hence, it is possible to put such compressor to practical use which less affects the ozone layer and global warming and makes it possible to improve the refrigeration cycle performance.

DESCRIPTION OF EMBODIMENTS

Figure 1:
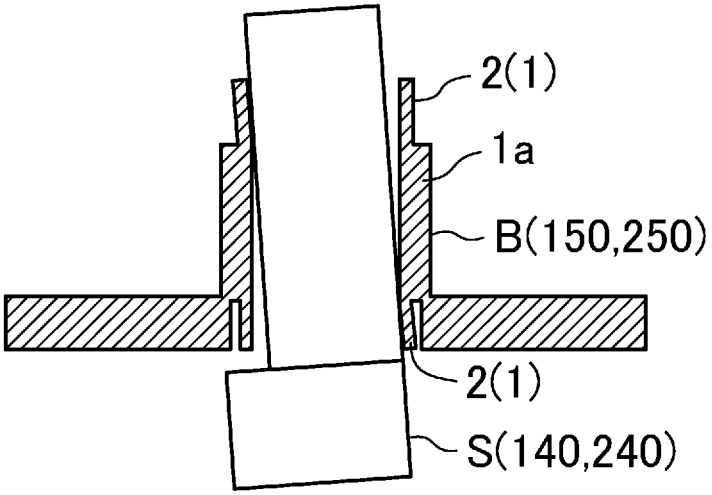
FIG. 1 is a cross-sectional view illustrating a bearing structure of a compressor according to a first embodiment.

In the following, embodiments will be described in detail with reference to the drawings. The present embodiment relates to a compressor compressing refrigerants including hydrocarbon fluoride prone to disproportionation. The compressor is provided in a refrigerant circuit and performs compression phase of a refrigeration cycle. As specifically explained in connection with the first to the fifth embodiments described later, the compressor includes a casing, a compression mechanism housed in the casing, and an electric motor driving the compression mechanism. As shown in FIG. 1 described later, the compressor further includes a drive shaft (S) connecting the compression mechanism with the electric motor and a bearing portion (B) rotatably supporting the drive shaft (S). The compressor includes, on a contact portion of the drive shaft (S) and the bearing portion (B), a heat generation suppression portion (1) suppressing excessive heat generation due to line contact of an end edge portion of the bearing portion (B) with the drive shaft (S) during rotation of the drive shaft (S).

First Embodiment

The first embodiment will be described.

First, a schematic configuration of the bearing structure will be described. In this first embodiment, the heat generation suppression portion (1) is configured of an elastic bearing portion (2) schematically shown in FIG. 1. As illustrated, in the first embodiment, an end edge portion of the bearing portion (B) is provided with, on the contact portion of the drive shaft (S) and the bearing portion (B), the elastic bearing portion (2) formed to be elastic due to thin structure, since the outer diameter of the elastic bearing portion (2) is smaller than that of a main body portion except for the above end edge. FIG. 1 shows a state in which the drive shaft (S) is inclined. The elastic bearing portion (2) elastically deforms in accordance with the inclination of the drive shaft.

Figure 2:
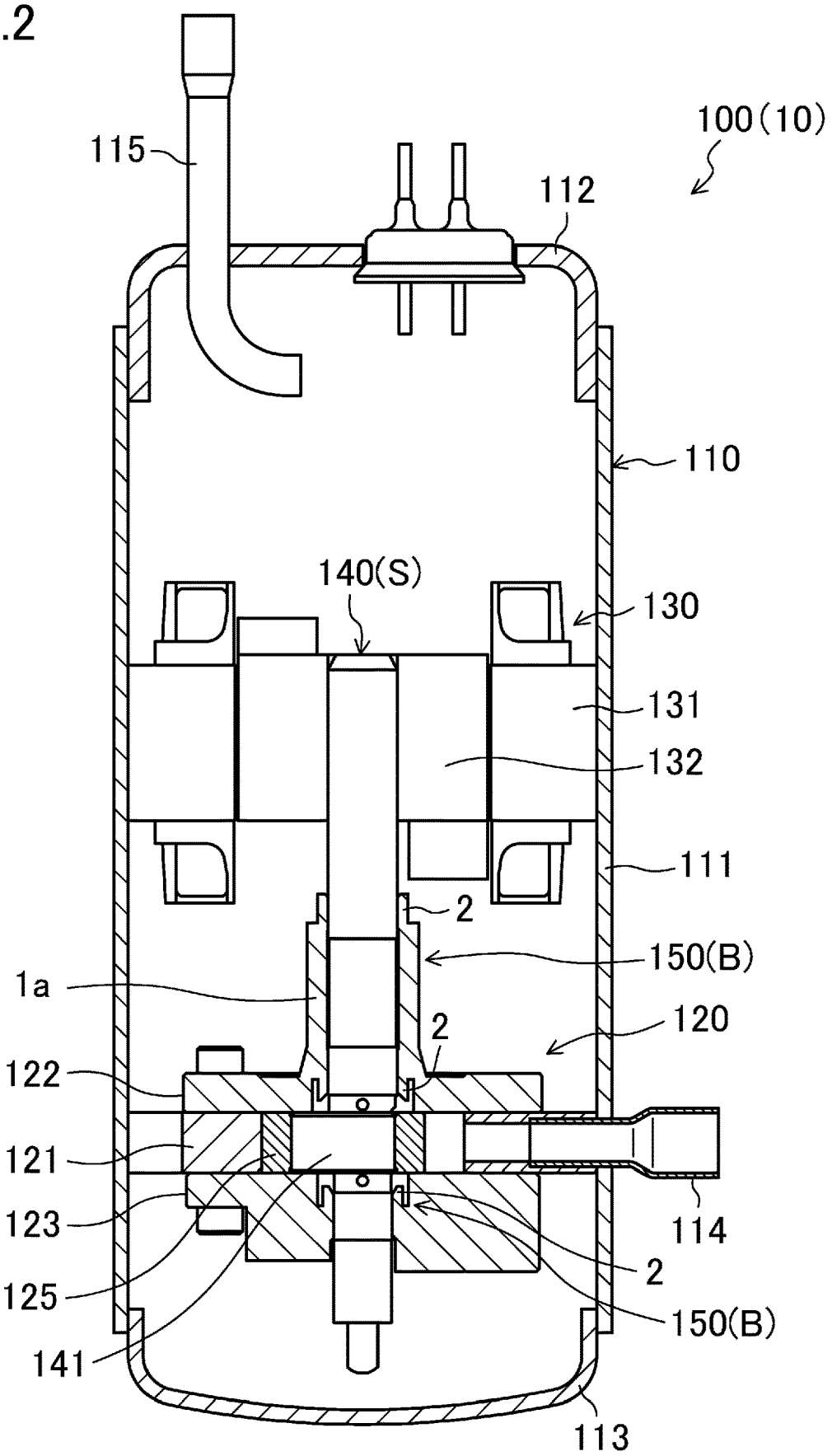
FIG. 2 is a vertical cross-sectional view of a swing piston type compressor according to the first embodiment.

The specific configuration of the compressor (100) will be described next. As shown in FIG. 2, the compressor (10) of the first embodiment is a swing piston type compressor (100). The elastic bearing portion (2) is applied as a bearing structure of the swing piston type compressor (100). This swing piston type compressor (100) includes a casing (110), a compression mechanism (120) housed in the casing (110), an electric motor (130) driving the compression mechanism (120), a drive shaft (140) (drive shaft (S) of FIG. 1) connecting the compression mechanism (120) and the electric motor (130), and a bearing portion (150) (bearing portion (B) of FIG. 1) rotatably supporting the drive shaft (140).

The casing (110) includes a barrel (111) formed into a vertically long cylindrical shape, an upper end plate (112) fixed on an upper end of the barrel (111), and a lower end plate (113) fixed on an lower end of the barrel (111). The casing (110) is provided with a suction pipe (114) passing through the barrel (111) and a discharge pipe (115) passing through the upper end plate (112).

Figure 3:
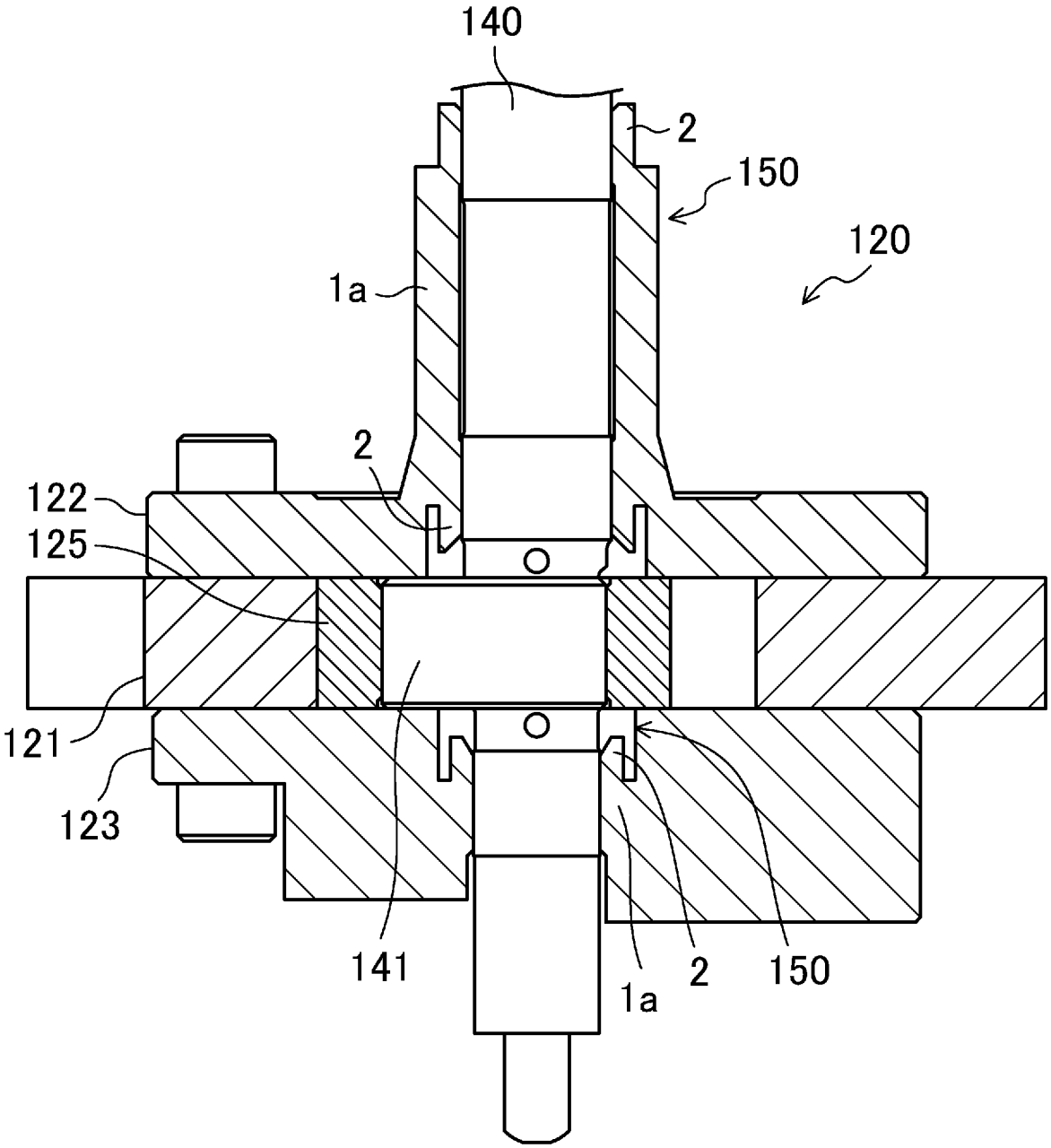
FIG. 3 is an enlarged view of an essential part of FIG. 2.

As shown in FIG. 2 and FIG. 3, the compression mechanism (120) includes a cylinder (121) which is formed into an annular shape and has space defining a cylinder chamber (compression chamber), a front head (122) fixed on an upper end face of the cylinder (121), and a rear head (123) fixed on a lower end face of the cylinder (121). The front head (122), the cylinder (121) and the rear head (123) are integrally fastened with each other through a fastening member such as a bolt. The compression mechanism (120) is fixed on the casing (110) through joining the cylinder (121) on the barrel (111) of the casing (110). Further, the cylinder chamber of the compression mechanism (120) is provided with a piston (125) eccentrically rotating in the cylinder chamber.

The electric motor (130) is provided with a stator (131) fixed to the casing (110) above the compression mechanism (120) and a rotor (132) located inside the stator (131) and rotating with respect to the stator (131).

Figure 4:
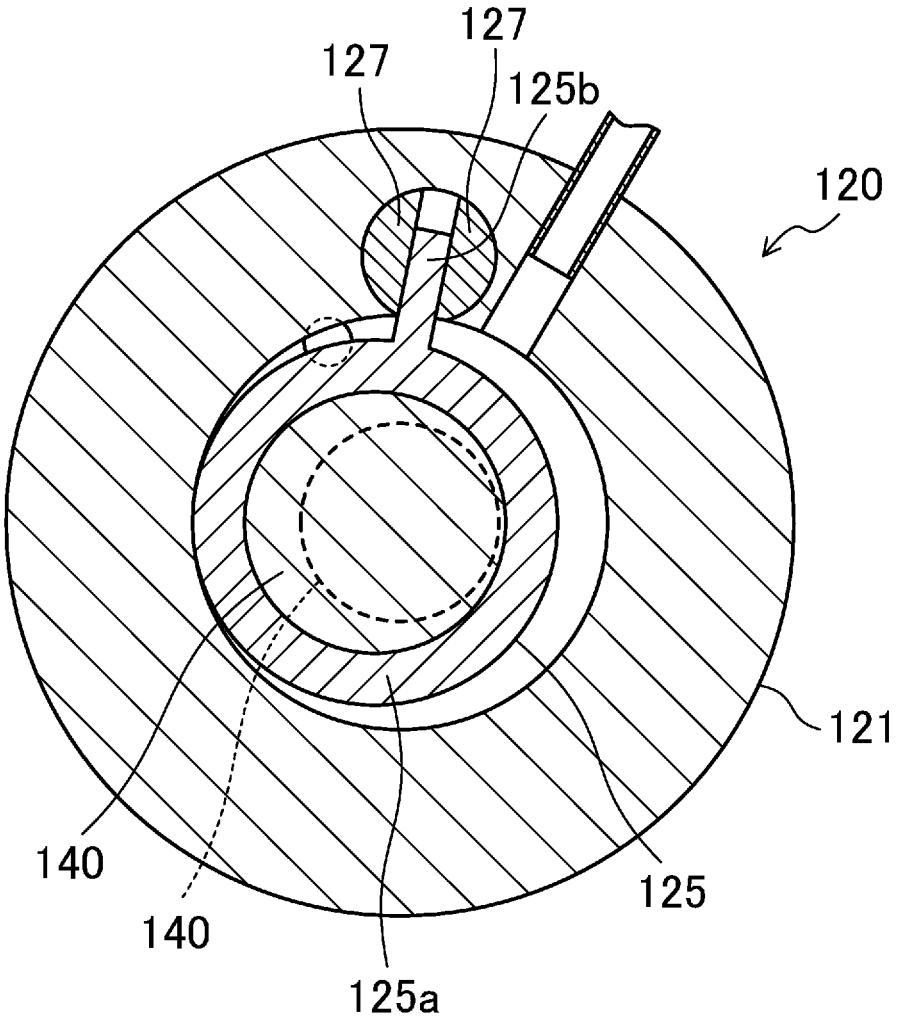
FIG. 4 is a horizontal cross-sectional view of a compression mechanism.

The drive shaft (140) is fixed to the rotor (132) of the electric motor (130) and rotates integrally with the rotor (132). Further, the drive shaft (140) has an eccentric portion (141) engaging with the piston (125) of the compression mechanism (120), and is rotatably supported by the bearing portion (150) of the front head (122) located above the piston (125) and by the bearing portion (150) of the rear head (123) located below the piston (125). As shown in FIG. 4, the piston (125) integrally includes an annular portion (125*a*) and a blade (125*b*) extending from the annular portion (125*a*) toward an outer periphery. The blade (125*b*) is swingably supported by a swing bush (127) attached to the piston (125).

The upper and lower end edge portions of the bearing portion (150) of the front head (122) are each provided with an elastic bearing portion (2) formed to be elastic due to thin structure, since the outer diameter of the elastic bearing portion (2) is smaller than that of a main body portion (la) except for the corresponding end edge. The upper end edge portion of the bearing portion (150) of the rear head (123) includes an elastic bearing portion (2) whose outer diameter is smaller than that of the main body portion (la) of the bearing portion (150).

—Refrigerant—

As a refrigerant filled in the refrigerant circuit and compressed by this swing piston type compressor (100), it is possible to use a single component refrigerant including hydrocarbon fluoride prone to disproportionate or a refrigerant mixture including hydrocarbon fluoride prone to disproportionation and at least one refrigerant other than the refrigerant including hydrocarbon fluoride.

As a hydrocarbon fluoride prone to disproportionation, it is possible to use hydrofluoroolefin (HFO) including a carbon-carbon double bond which less affects the ozone layer and global warming and is easily decomposed by OH radicals. Specifically, as an example of such HFO refrigerants, it is preferable to use trifluoroethylene (HFO-1123) having excellent performance disclosed in Japanese Unexamined Patent Application Publication No. 2015-7257 and Japanese Unexamined Patent Application Publication No. 2016-28119. Further, it is possible to use, as HFO refrigerants other than HFO-1123, such refrigerants prone to disproportionation which are selected from 3,3,3-trifluoropropen (HFO-1243zf), 1,3,3,3-tetrafluoropropen (HFO-1234ze), 2-fluoropropen (HFO-1261yf), 2,3,3,3-tetrafluoropropen (HFO-1234yf), and 1,1,2-trifluoropropen (HFO-1243yc) disclosed in Japanese Unexamined Patent Application Publication No. H04-110388 and 1,2,3,3,3-pentafluoropropen (HFO-1225ye), trans-1,3,3,3-tetrafluoropropen (HFO-1234ze(E)) and cis-1,3,3,3-tetrafluoropropen (HFO-1234ze(Z)) disclosed in Japanese Translation of Unexamined Patent Application Publication No. 2006-512426, as long as they are prone to disproportionation. Examples of hydrocarbon fluoride prone to disproportionation may include acetylenic hydrocarbon fluoride including a carbon-carbon triple bond.

Further, in case where a refrigerant mixture including hydrocarbon fluoride prone to disproportionation is used, the refrigerant mixture preferably includes the above-mentioned HF-1123. For example, a refrigerant mixture made of HFO-1123 and HFC-32 may be used. It is preferable that the composition ratio of this refrigerant mixture is, for example, as follows: HFO-1123:HFC-32=40:60 (unit:weight %). Moreover, a refrigerant mixture made of HFO-1123, HFC-32 and HFO-1234yf may also be used. It is preferable that the composition ratio of this refrigerant mixture is, for example, as follows: HFO-1123:HFC-32:HFO-1234yf=40:44:16 (unit:weight %). Further, AMOLEA X series refrigerants (trademark: manufactured by Asahi Glass Co., Ltd.) or AMOLEA Y series refrigerants (trademark: manufactured by Asahi Glass Co., Ltd.) may also be used as refrigerant mixtures.

As other refrigerants included in refrigerant mixtures, other substances which vaporize and liquefy together with HFO-1123 such as hydrocarbons (HC), hydrofluorocarbons (HFC), hydrochlorofluoroolefins (HCFO), and chlorofluoroolefins (CFO) may appropriately be used.

HFC is a component that improves performance, and less affects the ozone layer and global warming. It is preferable to use HFC having five or fewer carbon atoms. Specifically, examples of HFC include difluoromethane (HFC-32), difluoroethane (HFC-152a), trifluoroethane (HFC-143), tetrafluoroethane (HFC-134), pentafluoroethane (HFC-125), pentafluoropropane (HFC-245ca), hexafluoropropane (HFC-236fa), heptafluoropropane (HFC-227ea), pentafluorobutane (HFC-365), and heptafluorocyclopentane (HFCP). Among the HFCs mentioned above, difluoromethane (HFC-32), 1,1-difluoroethane (HFC-152a), 1,1,2,2-tetrafluoroethane (HFC-134), and 1,1,1,2-tetrafluoroethane (HFC-134a) and pentafluoroethane (HFC-125) are particularly preferable under consideration of the fact that they less affect the ozone layer and global warming. These HFCs may be used alone or two or more of them may be used in combination.

HCFO is a compound having a carbon-carbon double bond, a large proportion of halogen in the molecule, and a suppressed combustibility. As HCFO, 1-chloro-2,3,3,3-tetrafluoropropene (HCFO-1224yd), 1-chloro-2,2-difluoroethylene (HCFO-1122), 1,2-dichlorofluoroethylene (HCFO-1121), 1-chloro-2-fluoroethylene (HCFO-1131), 2-chloro-3,3,3-trifluoropropene (HCFO-1233xf) and 1-chloro-3,3,3-trifluoropropene (HCFO-1233zd) may be used. Among these, HCFO-1224yd having particularly excellent performance is preferable. In addition, HCFO-1233zd is preferable since it has a high critical temperature, high durability and excellent coefficient of performance. HCFOs other than HCFO-1224yd may be used alone or two or more of these HCFOs may be used in combination.

—Operation of Bearing Part—

When the swing piston type compressor (100) of the first embodiment is operated, for example, under a high load or at a high rpm, each of the elastic bearing portions (2) elastically deforms when the drive shaft (140) is inclined as illustrated in FIG. 1. In this way, a partial contact (line contact) between the drive shaft (140) and the bearing portion (150) is less likely to occur, resulting in suppression of rise in temperature. When the oscillation piston type compressor (100) is restarted after prolonged stop with lubricant dropping down from the bearing portion (150), a partial contact occurs in a conventional configuration before the lubricant is supplied to a sliding portion, resulting in that metals of corresponding parts intensively contact each other. On the contrary, in this first embodiment, such intensive contact between the metals of the corresponding parts can be avoided, thereby suppressing rise in temperature.

Advantages of First Embodiment

According to this first embodiment, since the elastic bearing portion (2) is provided as the heat generation suppression portion (1) at a contact portion of the drive shaft (140) and the bearing portion (150), when the swing piston type compressor (100) is operated under a high load or at a high rpm, it is possible to prevent a partial contact of the bearing portion (150) and resulting rapid local rise in temperature. As a result, in the swing piston type compressor (100) using a refrigerant prone to disproportionation, through a simple configuration, it is possible to suppress a partial contact of the bearing portion (150) and resulting rise in temperature of the refrigerant, thereby preventing the disproportional reaction of the refrigerant. Further, even when lubricant in the bearing portion (150) drops down in the swing piston type compressor (100) which has been stopped for a long time, it is possible to prevent the disproportional reaction at the time of restart of the compressor.

Variations of First Embodiment

<First Variation>

Figure 5:
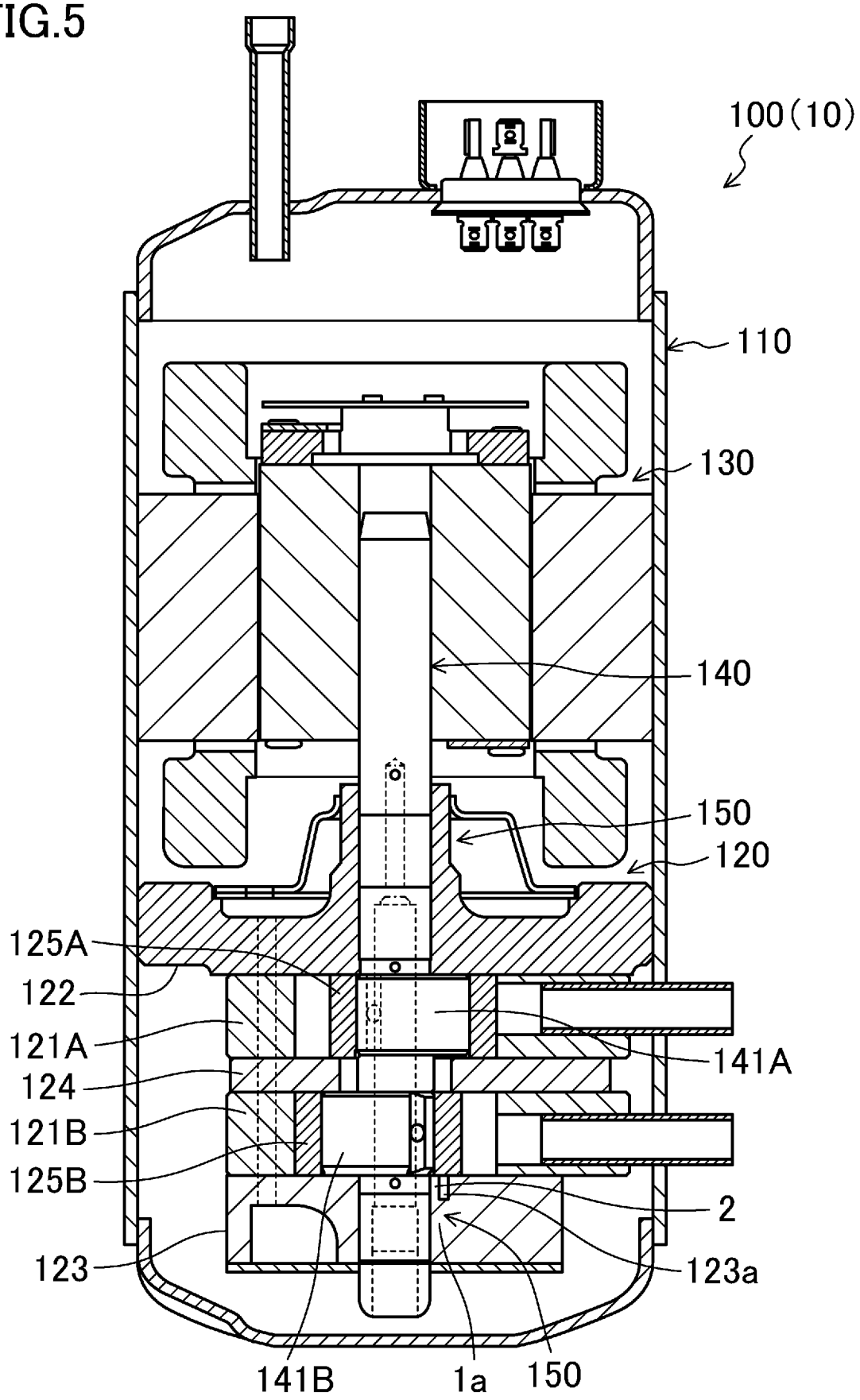
FIG. 5 is a vertical cross-sectional view of the swing piston type compressor according to a first variation of the first embodiment.
Figure 6:
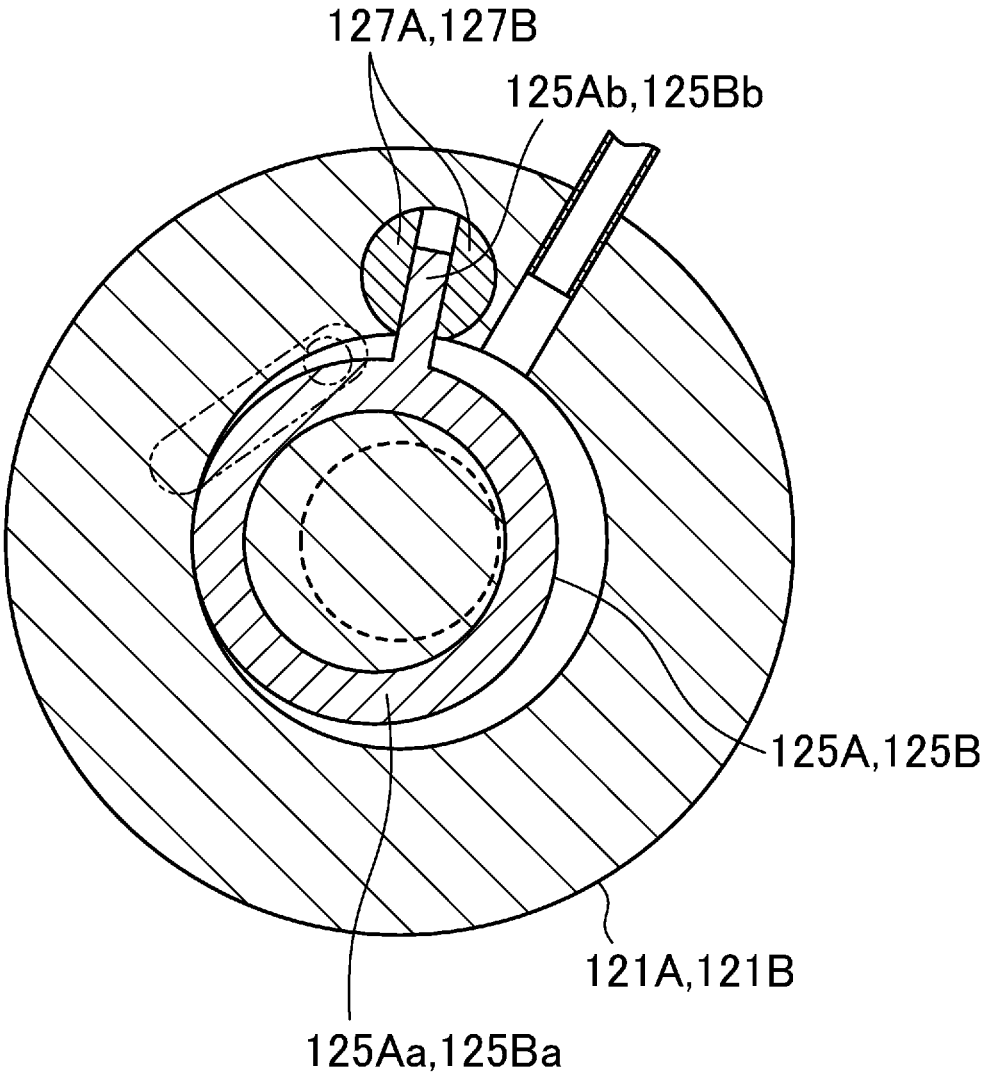
FIG. 6 is a horizontal cross-sectional view of a compression mechanism according to the first variation of the first embodiment.
Figure 7:
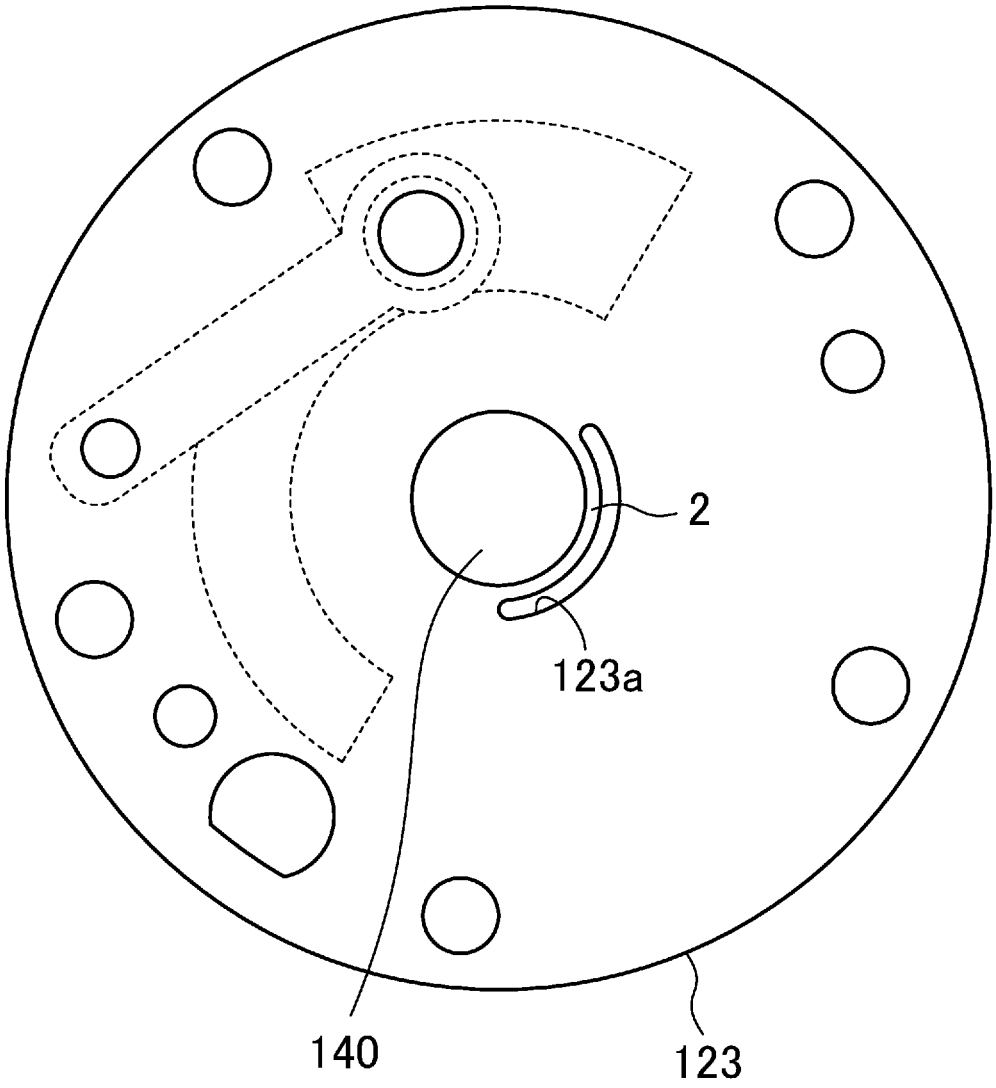
FIG. 7 is a plan view of a rear head according to the first variation of the first embodiment.

As shown in FIG. 5 to FIG. 7, in a first variation of the first embodiment, the elastic bearing portion (2) is applied to a bearing structure of the swing piston type compressor (100) with two cylinders.

As in the case with the first embodiment shown in FIG. 2 to FIG. 4, this swing piston type compressor (100) includes a casing (110), a compression mechanism (120) housed in the casing (110), an electric motor (130) driving the compression mechanism (120), a drive shaft (140) connecting the compression mechanism (120) and the electric motor (130), and a bearing portion (150) rotatably supporting the drive shaft (140).

The compression mechanism (120) is a configuration in which a front head (122), a first cylinder (121A), a middle plate (124), a second cylinder (121B), and a rear head (123) are fastened with one another through a fastening member such as a bolt to be integrally formed. A first piston (125A) is disposed in the first cylinder (121A), while a second piston (125B) is disposed in the second cylinder (121B).

The drive shaft (140) is fixed to the rotor (132) of the electric motor (130), rotates integrally with the rotor (132) and is provided with a first eccentric portion (141A) engaging with the first piston (125A) and a second eccentric portion (141B) engaging with the second piston (125B). This drive shaft (140) is rotatably supported by the bearing portion (150) of the front head (122) and the bearing portion (150) of the rear head (123).

As shown in FIG. 6, the first piston (125A) and the second piston (125B) are configured in the same manner as the piston (125) of the first embodiment. Specifically, the first piston (125A) is provided with an annular portion (125Aa) and a blade (125Ab) extending from the annular portion (125Aa) toward the outer periphery, which are integrally formed. The blade (125Ab) is supported by an oscillation bush (127A). The second piston (125B) is provided with an annular portion (125Ba) and a blade (125Bb) extending from the annular portion (125Ba) toward the outer periphery, which are integrally formed. The blade (125Bb) is supported by an oscillation bush (127B).

In this embodiment, the bearing portion (150) of the rear head (123) is provided with an elastic bearing portion (2). As shown in FIG. 7, the elastic bearing portion (2) is formed such that a groove (123*a*) having an arc-like shape is formed in a part of the rear head (123) viewed in a circumferential direction so that the outer diameter of the bearing portion (150) of the rear head (123) is smaller than that of the main body portion (la) of the bearing portion (150).

The groove having the arch-like shape as illustrated is an arc of about 130°. The range of the degrees of the arc is not limited thereto. The groove may be, for example, a semicircle of about 180°.

In the above configuration, in case where this swing piston type compressor (100) is operated, for example, under a high load or at a high rpm, the elastic bearing portion (2) elastically deforms when the drive shaft (140) is inclined as illustrated in FIG. 1. In this way, a partial contact (line contact) between the drive shaft (140) and the bearing portion (150) is less likely to occur, resulting in suppression of rise in temperature. When the swing piston type compressor (100) is restarted after prolonged stop in a state in which lubricant drops down from the bearing portion (150), a partial contact occurs in a conventional configuration before the lubricant is supplied to a sliding portion, resulting in that metals of corresponding parts intensively contact each other. On the contrary, in the first variation of the first embodiment, such intensive contact between the metals of the corresponding parts can be avoided, thereby suppressing rise in temperature.

Therefore, even when the swing piston type compressor (100) is operated under a high load or at a high rpm, it is possible to prevent a partial contact of the bearing portion (150) and resulting rapid local temperature rise As a result, in the swing piston type compressor (100) using a refrigerant prone to disproportionation, through a simple configuration, it is possible to suppress a partial contact of the bearing portion (150) and resulting rise in temperature of the refrigerant, thereby preventing the disproportional reaction of the refrigerant.

<Second Variation>

Figure 8:
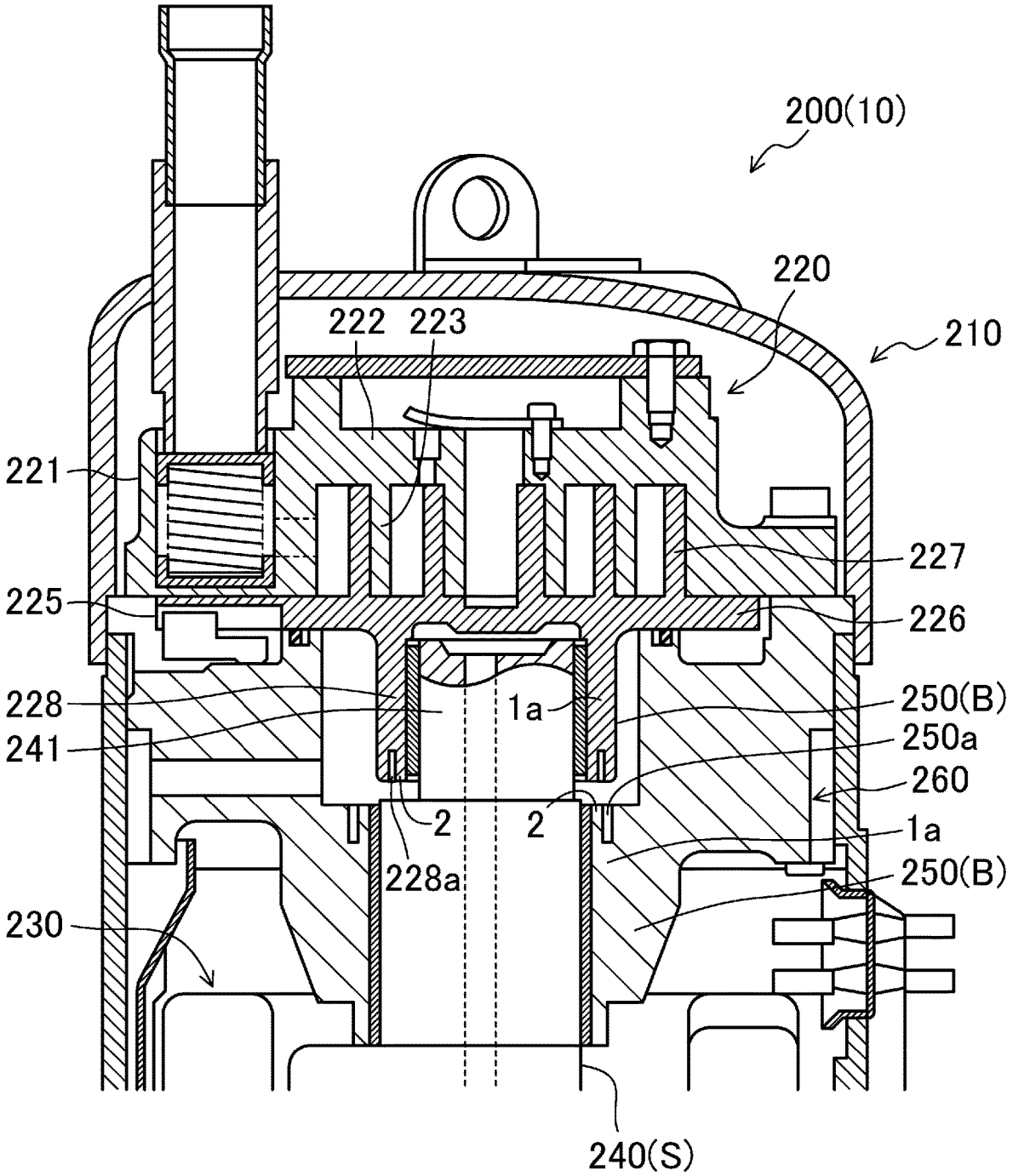
FIG. 8 is a vertical cross-sectional view of a scroll compressor according to a second variation of the first embodiment.

As shown in FIG. 8, in a second variation of the first embodiment, the elastic bearing portion (250) (elastic bearing portion (2) of FIG. 1) is applied to a bearing structure of the scroll compressor (200).

This scroll compressor (200) includes a casing (210), a compression mechanism (220) housed in the casing (210), an electric motor (230) located below the compression mechanism (220) and driving the compression mechanism (220), a drive shaft (240)(S) connecting the compression mechanism (220) and the electric motor, and a bearing portion (250) (bearing portion (B) of FIG. 1) rotatably supporting the drive shaft (240) (drive shaft (S) of FIG. 1).

The compression mechanism (220) is provided with a fixed scroll (221) and a movable scroll (225). The fixed scroll (221) is obtained by integrally forming a fixed end plate (222) and a fixed lap (223). The movable scroll (225) is obtained by integrally forming a movable end plate (226) and a movable lap (227). The fixed lap (223) and the movable lap (227) are wall parts meshing with each other and formed into a spiral shape. A compression chamber is defined between the fixed lap (223) and the movable lap (227).

A housing (260) is fixed on the casing (210). The fixed scroll (221) is attached to the housing (260) through a fastening member such as a bolt. The housing (260) constitutes the above bearing portion (250) rotatably supporting the drive shaft (240) whose eccentric portion (241) is connected to a boss portion (228) formed on the movable scroll (225). The above boss portion (228) also constitutes the bearing portion (250) rotatably supporting the eccentric portion (241) of the drive shaft (240).

The bearing portion (250) of the housing (260) is provided with a groove portion (250*a*) formed into a circular shape with its outer diameter smaller than that of the main body portion (la) of the bearing portion (250). The inside of this groove portion (250*a*) constitutes the elastic bearing portion (2). Also on a lower end of the boss portion (228), there is provided a groove portion (228*a*) formed into a circular shape. The elastic bearing portion (2) with its outer diameter smaller than that of the main body portion (la) of the boss portion (228) (bearing portion (250)) is formed by this groove portion (228*a*) formed into the circular shape.

As described above, in the second variation of the first embodiment, the elastic bearing portions (2) are respectively provided on the bearing portion (250) of the housing (260) supporting a main shaft portion of the drive shaft (240) and on the boss portion (228) (bearing portion (250)) of the movable scroll (225) supporting the eccentric portion (241) of the drive shaft (240).

In the above configuration, in case where the scroll compressor (200) is operated, for example, under a high load or at a high rpm, each of the elastic bearing portions (2) elastically deforms when the drive shaft (240) is inclined as illustrated in FIG. 1. In this way, a partial contact (line contact) between the drive shaft (240) and the bearing portion (250) is less likely to occur, resulting in suppression of rise in temperature. When the scroll compressor (200) is restarted after prolonged stop in a state in which lubricant drops down from the bearing portion (250), a partial contact occurs in a conventional configuration before the lubricant is supplied to a sliding portion, resulting in that metals of corresponding parts intensively contact each other. On the contrary, in the second variation of the first embodiment, such intensive contact between the metals of the corresponding parts can be avoided, thereby suppressing rise in temperature.

Therefore, even when the scroll compressor (200) is operated under a high load or at a high rpm, it is possible to prevent a partial contact of the bearing portion (250) and resulting rapid local temperature rise As a result, in the scroll compressor (200) using a refrigerant prone to disproportionation, through a simple configuration, it is possible to suppress a partial contact of the bearing portion (250) and resulting rise in temperature of the refrigerant, thereby preventing the disproportional reaction of the refrigerant.

Second Embodiment

A second embodiment will be described.

Figure 9:
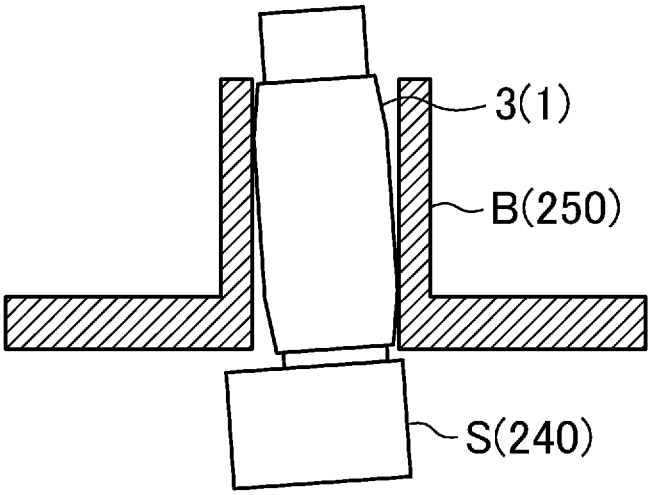
FIG. 9 is a cross-sectional view of a bearing structure of a compressor according to a second embodiment.

In this second embodiment, the heat generation suppression portion (1) is configured of a shaft side crowning portion (3) shown in FIG. 9. As illustrated, in this configuration, the above drive shaft (S) is provided with, on its engagement portion engaging with the above bearing portion (B), the shaft side crowning portion (3) with its outer diameter decreasing in direction from a center portion toward an end edge portion of the engagement portion.

As the refrigerant compressed by this compressor, the same refrigerant as that used in the first embodiment is used.

Figure 10:
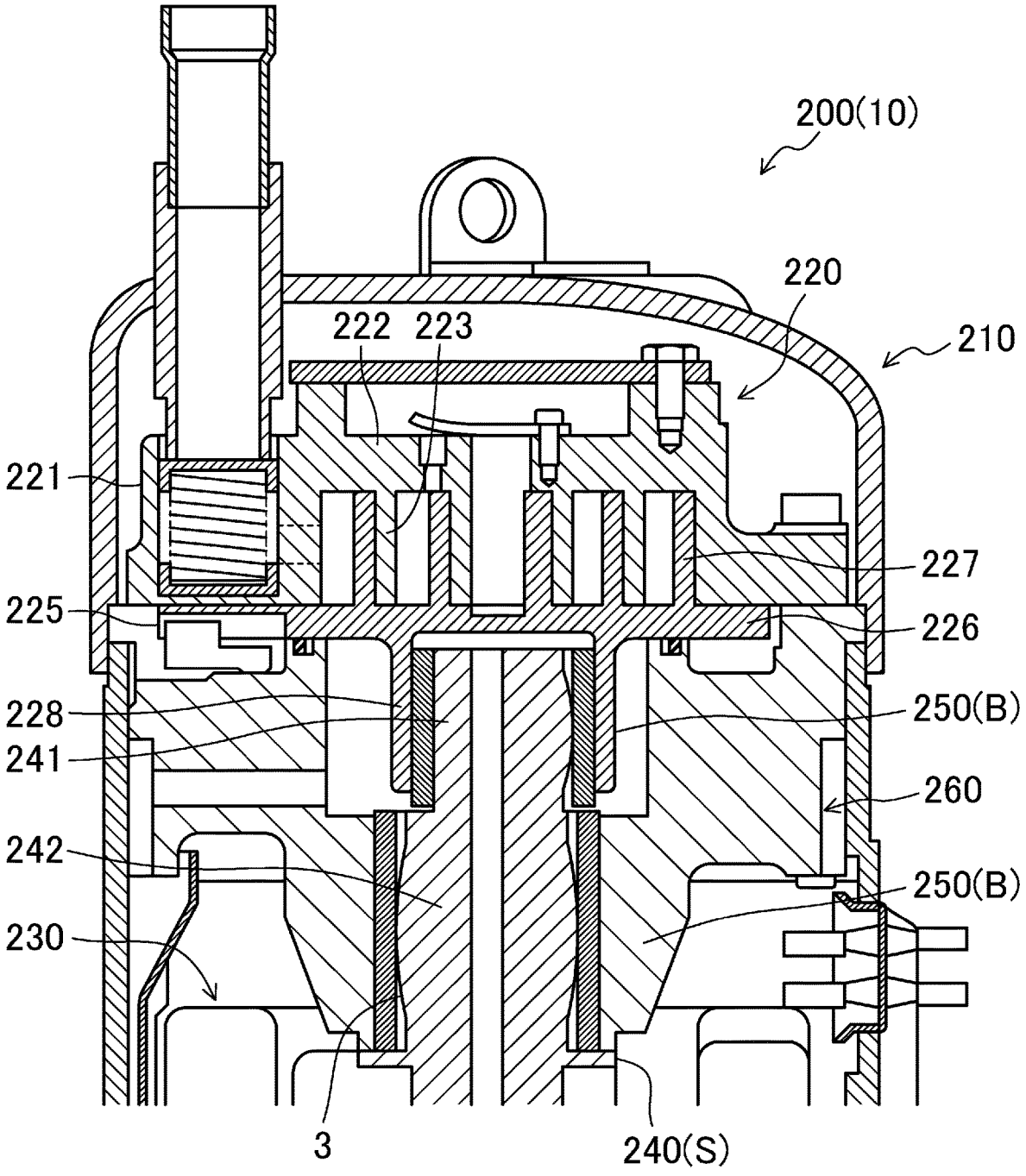
FIG. 10 is a vertical cross-sectional view of a scroll compressor according to the second embodiment.

As shown in FIG. 10, the compressor (10) of the second embodiment is a scroll compressor (200). As in the case with the second variation of the first embodiment, this scroll compressor (200) includes a casing (210), a compression mechanism (220) housed in the casing (210), an electric motor (230) located below the compression mechanism (220) and driving the compression mechanism (220), a drive shaft (240) (drive shaft (S) of FIG. 2) connecting the compression mechanism (220) and the electric motor, and a bearing portion (250) (bearing portion (B) of FIG. 2) rotatably supporting the drive shaft (240).

The compression mechanism (220) is provided with a fixed scroll (221) and a movable scroll (225). The fixed scroll (221) is obtained by integrally forming a fixed end plate (222) and a fixed lap (223). The movable scroll (225) is obtained by integrally forming a movable end plate (226) and a movable lap (227). The fixed lap (223) and the movable lap (227) are wall parts meshing with each other and formed into a spiral shape. A compression chamber is defined between the fixed lap (223) and the movable lap (227).

A housing (260) is fixed on the casing (210). The fixed scroll (221) is attached to the housing (260) through a fastening member such as a bolt. The housing (260) constitutes the bearing portion (250) rotatably supporting the drive shaft (240) whose eccentric portion (241) is connected to a boss portion (228) formed on the movable scroll (225). The above boss portion (228) also constitutes the bearing portion (250) rotatably supporting the eccentric portion (241) of the drive shaft (240).

A shaft side crowning portion (3) is formed on a main shaft portion (242) of the drive shaft (240) supported by the bearing portion (250) of the housing (260). The shaft side crowning portion (3) is formed similarly on the eccentric portion (241) of the drive shaft (240) supported by the boss portion (228).

As described above, in this second embodiment, the main shaft portion (242) and the eccentric portion (241) of the drive shaft (240) are each provided with the corresponding shaft side crowning portion (3).

In the above configuration, when the scroll compressor (200) is operated, for example, under a high load and at a high rpm, in case of inclination of the drive shaft (240) shown in FIG. 9, each of the shaft side crowning portions (3) receives the inclination of the drive shaft (240). In this way, a partial contact (line contact) between the drive shaft (240) and the bearing portion (250) is less likely to occur, resulting in suppression of rise in temperature. When the scroll compressor (200) is restarted after prolonged stop in a state in which lubricant drops down from the bearing portion (250), a partial contact occurs in a conventional configuration before the lubricant is supplied to a sliding portion, resulting in that metals of corresponding parts intensively contact each other. On the contrary, in this second embodiment, such intensive contact between the metals of the corresponding parts can be avoided, thereby suppressing rise in temperature.

Therefore, even when the scroll compressor (200) is operated under a high load or at a high rpm, it is possible to prevent a partial contact of the bearing portion (250) and resulting rapid local temperature rise As a result, in the scroll compressor (200) using a refrigerant prone to disproportionation, through a simple configuration, it is possible to suppress a partial contact of the bearing portion (250) and resulting rise in temperature of the refrigerant, thereby preventing the disproportional reaction of the refrigerant.

Third Embodiment

The third embodiment will be described.

Figure 11:
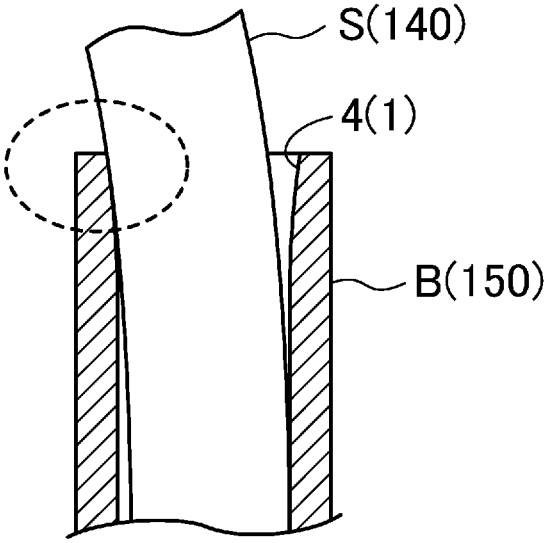
FIG. 11 is a cross-sectional view of a bearing structure of a compressor according to a third embodiment.

In this third embodiment, the heat generation suppression portion (1) is configured by a bearing side crowning portion (4) shown in FIG. 11. As illustrated, in the third embodiment, the above bearing portion (B) is provided with, on its engagement portion engaging with the above drive shaft (S), a bearing side crowning portion (4) with its inner diameter increasing in direction from a center portion toward an end edge portion of the engagement portion.

As the refrigerant compressed by this compressor (10), the same refrigerant as the first and the second embodiments is used.

Figure 12:
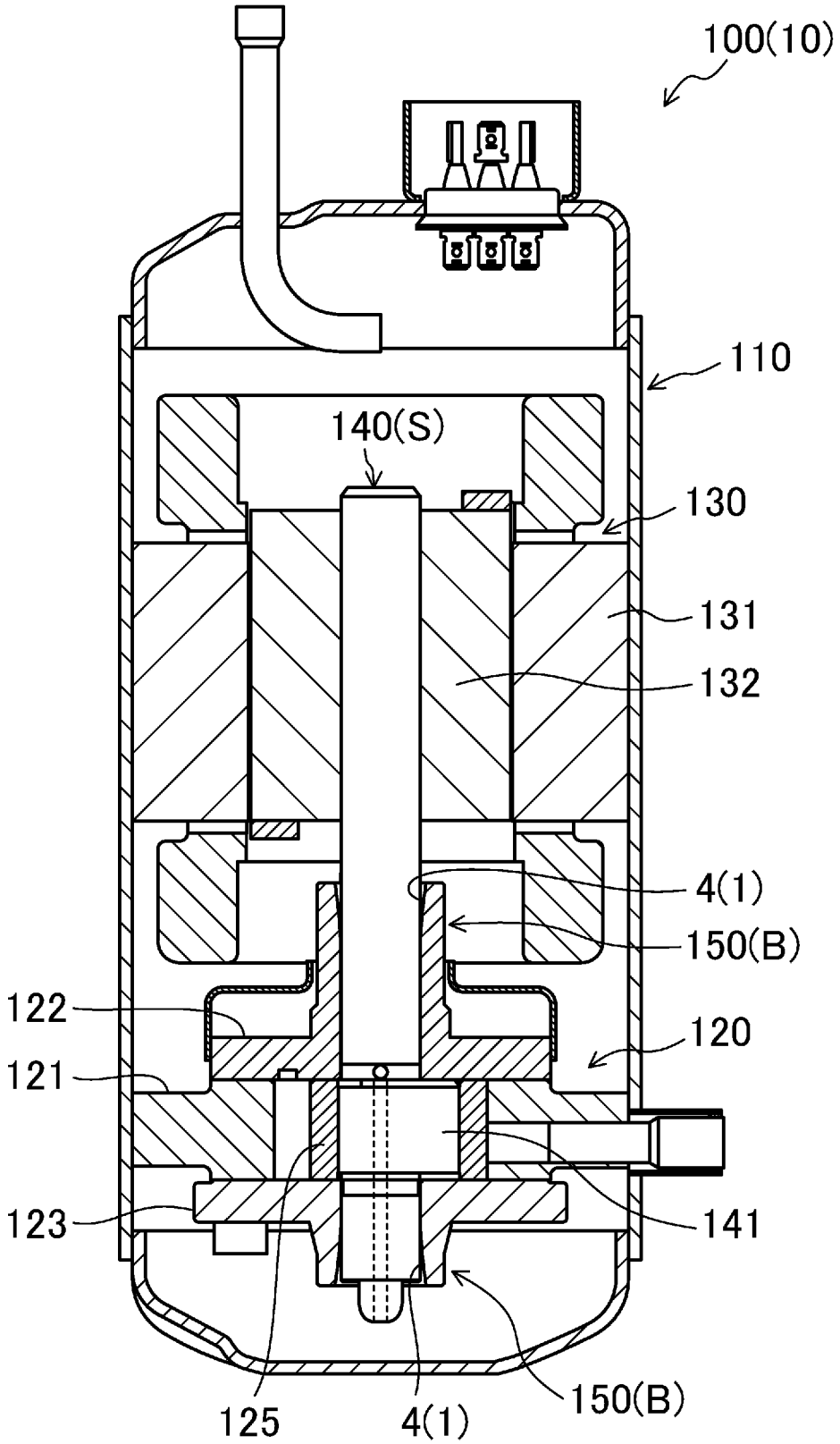
FIG. 12 is a vertical cross-sectional view of a swing piston type compressor according to the third embodiment.

As shown in FIG. 12, in the third embodiment, the bearing side crowning portion (4) is applied to the bearing structure of the swing piston type compressor (100).

As in the case with the first embodiment shown in FIG. 2 to FIG. 4, this swing piston type compressor (100) includes a casing (110), a compression mechanism (120) housed in the casing (110), an electric motor (130) driving the compression mechanism (120), a drive shaft (140) connecting the compression mechanism (120) and the electric motor (130), and a bearing portion (150) rotatably supporting the drive shaft (140).

The compression mechanism (120) is a configuration in which a front head (122), a cylinder (121), and a rear head (123) are integrally fastened with each other through a fastening member such as a bolt. A piston (125) is attached in the cylinder (121).

The drive shaft (140) is fixed to the rotor (132) of the electric motor (130), rotates integrally with the rotor (132) and is provided with an eccentric portion (141) engaging with the piston (125). This drive shaft (140) is rotatably supported by the bearing portion (150) of the front head (122) and the bearing portion (150) of the rear head (123).

In this third embodiment, the bearing portion (150) of the front head (122) and the bearing portion (150) of the rear head (123) are each provided with a bearing side crowning portion (4). These bearing side crowning portions (4) are portions formed as a curved surface or a tapered surface on engagement portions engaging with the above drive shaft (140) in the respective bearing portions (150) of the front head (122) and the rear head (123) such that the inner diameter of each of the bearing side crowning portion (4) increases in direction from a center portion toward the end edge portion of the corresponding engagement portion.

Figure 13:
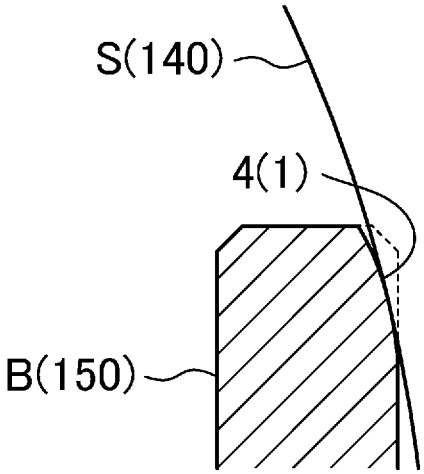
FIG. 13 is an enlarged view of an essential part of a bearing structure.

In the above configuration, when this swing piston type compressor (100) is operated, for example, under a high load or at a high rpm, in case of inclination of the drive shaft (140) shown in FIG. 11, the bearing side crowning portion (4) receives the inclination of the drive shaft (140). Thus, conventionally, there arises a partial contact as outlined by the broken line of FIG. 13. On the contrary, according to this embodiment, a partial contact (line contact) between the drive shaft (140) and the bearing portion (150) is less likely to occur, resulting in suppressing rise in temperature. When the swing piston type compressor (100) is restarted after prolonged stop in a state in which lubricant drops down from the bearing portion (150), a partial contact occurs in a conventional configuration before the lubricant is supplied to a sliding portion, resulting in that metals of corresponding parts intensively contact each other. On the contrary, in this third embodiment, such intensive contact between the metals of the corresponding parts can be avoided, thereby suppressing rise in temperature.

Therefore, even when the swing piston type compressor (100) is operated under a high load or at a high rpm, it is possible to prevent a partial contact of the bearing portion (150) and resulting rapid local temperature rise As a result, in the oscillation piston type compressor (100) using a refrigerant prone to disproportionation, through a simple configuration, it is possible to suppress a partial contact of the bearing portion (150) and resulting rise in temperature of the refrigerant, thereby preventing the disproportional reaction of the refrigerant.

Fourth Embodiment

The fourth embodiment will be described.

Figure 14:
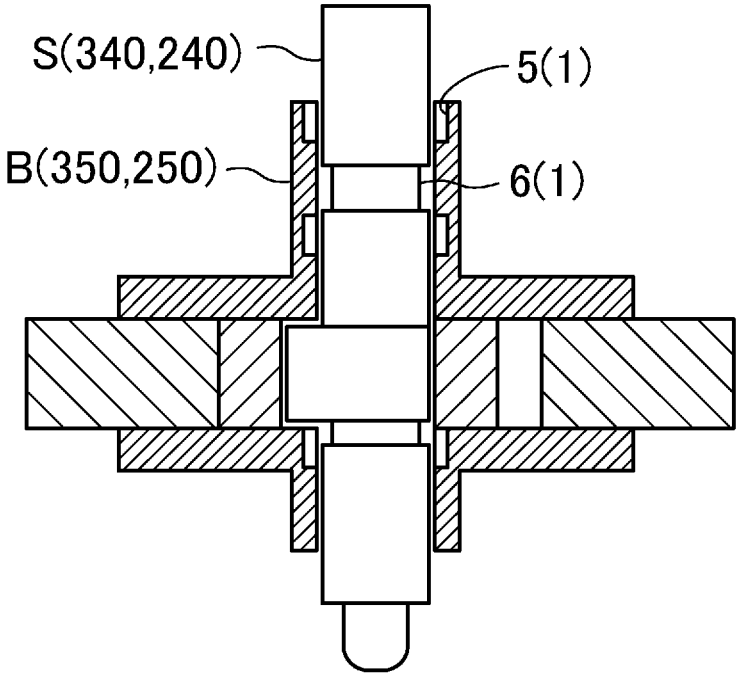
FIG. 14 is a cross-sectional view of a bearing structure of the compressors according to the fourth and the fifth embodiments.

In this fourth embodiment, the heat generation suppression portion (1) is configured by a bearing side oil groove portion (5) shown in FIG. 14. As illustrated, in this fourth embodiment, the end edge portion of the bearing portion (B) is provided with the bearing side oil groove portion (5) with its inner diameter larger than that of the main body except for the above end edge portion so as to store lubricant.

As the refrigerant compressed by the compressor (10), the same refrigerant as the first to the third embodiments is used.

Figure 15:
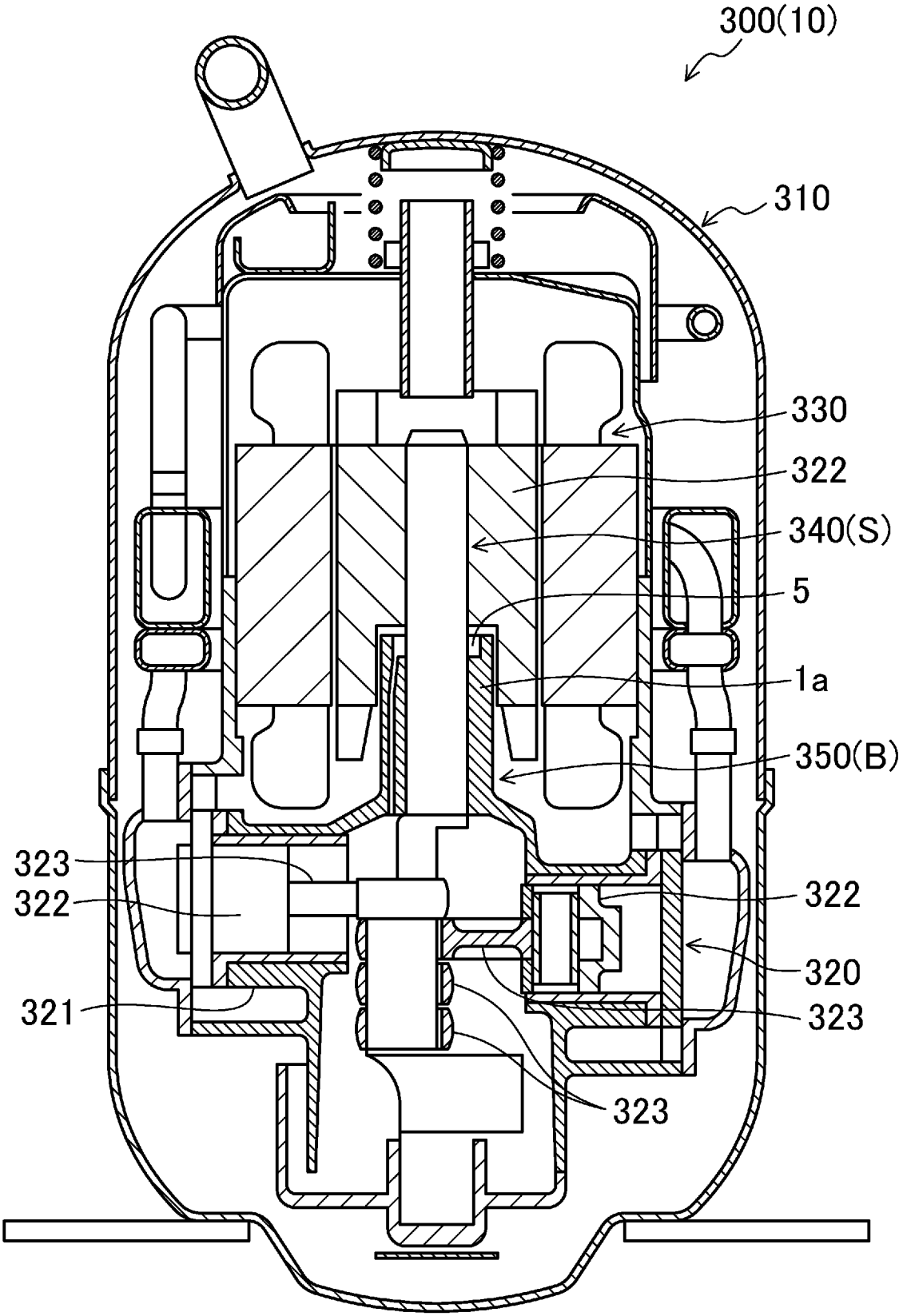
FIG. 15 is a vertical cross-sectional view of a reciprocation type compressor according to the fourth embodiment.

As shown in FIG. 15, in the fourth embodiment, the bearing side oil groove portion (5) is applied to a bearing structure of a reciprocation type compressor (300).

This reciprocation type compressor (300) includes a casing (310), a compression mechanism (320) of reciprocation type with four cylinders housed in the casing (310), an electric motor (330) driving the compression mechanism (320), a crankshaft (340) (drive shaft (S) of FIG. 14) connecting the compression mechanism (320) and the electric motor (330), and a bearing portion (350) (bearing portion (B) of FIG. 14) rotatably supporting the drive shaft (340).

The compression mechanism (320) is provided with a cylinder head (321) including four cylinder chambers arranged at, for example, 90° angular intervals in plan view, and a piston (322) reciprocating in each of the cylinder chambers. Each of the pistons (322) is connected to a corresponding piston rod (323). A crankshaft (340) (drive shaft (S)) is connected to the piston rod (323). Each of the pistons (322) reciprocates at a predetermined time point in the corresponding cylinder chamber, thereby compressing the refrigerant.

The crankshaft (340) is connected to the electric motor (330) located above the compression mechanism (320) and integrally rotates with the rotor (332) of the electric motor (330). The crankshaft (340) is rotatably supported by the bearing portion (350) which is integrally formed with the cylinder head (321) and has a tubular shape.

In this fourth embodiment, a bearing side oil groove portion (5) is formed on the bearing portion (350). This bearing side oil groove portion (5) is provided to the end of the bearing portion (350) such that the inner diameter of the bearing side oil groove portion (5) has the inner diameter larger than that of the main body portion (1) of the bearing portion (350) so as to store lubricant. Although not explained in detail, the lubricant is supplied from the cylinder head (321) to this bearing side oil groove portion (5).

In the above configuration, when the reciprocation type compressor (300) is operated, for example, under a high load and at a high rpm, in case of inclination of the drive shaft (340), the lubricant stored in the bearing side oil groove portion (5) is supplied between the drive shaft (340) and the bearing portion (350) so that an oil coating sufficient for prevention of seizing is formed. As a result, the drive shaft (340) and the bearing portion (350) come into surface-to-surface contact with each other with the oil coating provided therebetween. In this way, a partial contact between the drive shaft (340) (S) and the bearing portion (350) is less likely to occur, resulting in suppression of rise in temperature. When the reciprocation type compressor (300) is restarted after prolonged stop, a partial contact occurs in a conventional configuration before lubricant is supplied to a sliding portion, resulting in that metals of corresponding parts intensively contact each other. On the contrary, in this fourth embodiment, such intensive contact between the metals of the corresponding parts can be avoided, since the oil is stored in the bearing side oil groove portion (5), thereby suppressing rise in temperature.

Therefore, even when the reciprocation type compressor (300) is operated under a high load or at a high rpm, it is possible to prevent rapid local temperature rise in the bearing portion (350). As a result, in the reciprocation type compressor (300) using a refrigerant prone to disproportionation, through a simple configuration, it is possible to suppress a partial contact of the bearing portion (350) and resulting rise in temperature of the refrigerant, thereby preventing the disproportional reaction of the refrigerant.

Fifth Embodiment

The fifth embodiment will be described.

In this fifth embodiment, the heat generation suppression portion (1) is configured by a shaft side oil groove portion (6) shown in FIG. 14. As illustrated, in the fifth embodiment, the above drive shaft (S) is provided with, on a part of its engagement portion engaging with the above bearing portion (B), the shaft side oil groove portion (6) storing lubricant.

As the refrigerant compressed by the compressor (10), the same refrigerant as the first to the fourth embodiments is used.

In the fifth embodiment, the shaft side oil groove portion (6) is applied to the scroll compressor (200).

The basic configuration of this scroll compressor (200) is identical to that of the scroll compressors (200) of the second variation of the first embodiment and of the second embodiment. The compression mechanism (220) is provided with a fixed scroll (221) and a movable scroll (225). The boss portion (228) (bearing portion (250)) of the movable scroll (225) supports the eccentric portion (241) of the drive shaft (240). A main shaft portion (242) of the drive shaft (240) is rotatably supported by the housing (260) to which the fixed scroll (221) is fixed through a fastening member such as a bolt. Since the configuration of each of the parts is common to the second variation of the first embodiment and of the second embodiment except for the shaft side oil groove portion (6), a detailed description thereof will thus be omitted.

In this scroll compressor (200), the eccentric portion (241) of the drive shaft (240) is provided with an oil sump (245) having an annular space extending from the upper end face of the eccentric portion (241) to the position slightly above the lower end of the eccentric portion (241). The eccentric portion (241) of the drive shaft (240) is provided with the shaft side oil groove portion (6) communicating with this oil sump (245) and opening to an outer peripheral surface of the eccentric portion (241).

Figure 16:
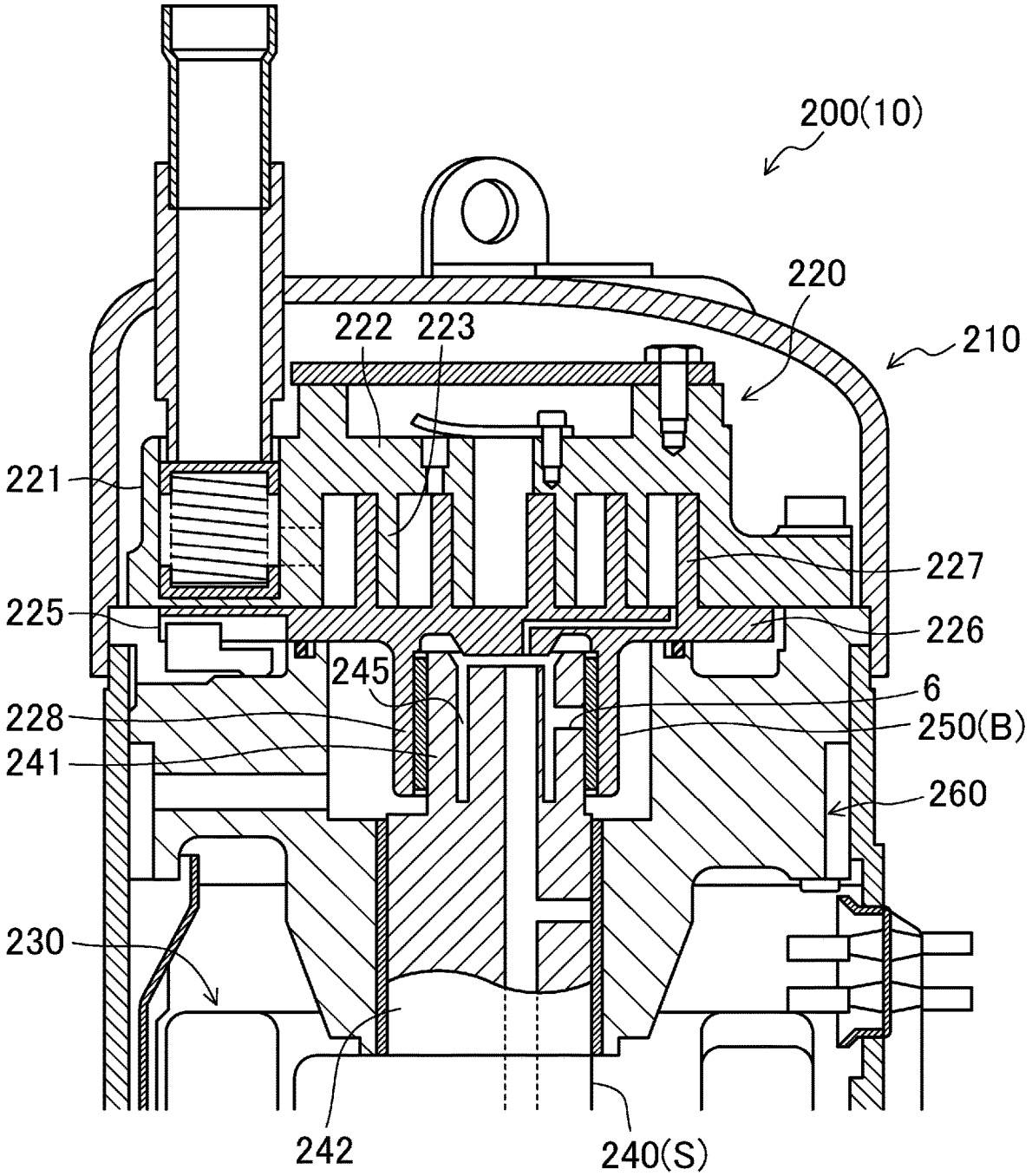
FIG. 16 is a partial cross-sectional view of a scroll compressor according to the fifth embodiment.

This shaft side oil groove portion (6) is configured such that a part of the engagement portion thereof engaging with the boss portion (228) (bearing portion (250)) stores the lubricant. Specifically, the shaft side oil groove portion (6) is constituted by a communication hole as illustrated in FIG. 16. Alternatively, as shown in FIG. 14, the shaft side oil groove portion (6) is configured to have a groove such that a part of the engagement portion of the drive shaft (240) engaging with the bearing portion (250) is provided with a groove with its outer diameter smaller than that of the main body portion except for the above part so that oil is stored in this groove.

In the above configuration, when this scroll compressor (200) is operated under a high load or at a high rpm, in case of inclination of the drive shaft (240), the lubricant stored in the shaft side oil groove portion (6) is supplied between the eccentric portion (241) of the drive shaft (240) and the boss portion (228) (bearing portion (250)) so that an oil coating sufficient for prevention of seizing is formed. As a result, the eccentric part (241) of the drive shaft (240) and the boss portion (228) come into surface-to-surface contact with each other with the oil coating provided therebetween. In this way, a partial contact between the eccentric portion (241) of the drive shaft (240) and the boss portion (228) is less likely to occur, resulting in suppression of rise in temperature. When the scroll compressor (200) is restarted after prolonged stop, a partial contact occurs in a conventional configuration before the lubricant is supplied to a sliding portion, resulting in that metals of corresponding parts intensively contact each other. On the contrary, in this fifth embodiment, such intensive contact between the metals of the corresponding parts can be avoided, since oil is stored in the shaft side oil groove portion (6), thereby suppressing rise in temperature.

Therefore, even when the scroll compressor (200) is operated under a high load or at a high rpm, it is possible to prevent resulting rapid local temperature rise of the bearing portion (250). As a result, in the scroll compressor (200) using a refrigerant prone to disproportionation, through a simple configuration, it is possible to suppress a partial contact of the bearing portion (250) and resulting rise in temperature of the refrigerant, thereby preventing the disproportional reaction of the refrigerant.

Variation of Fifth Embodiment

<First Variation>

Figure 17:
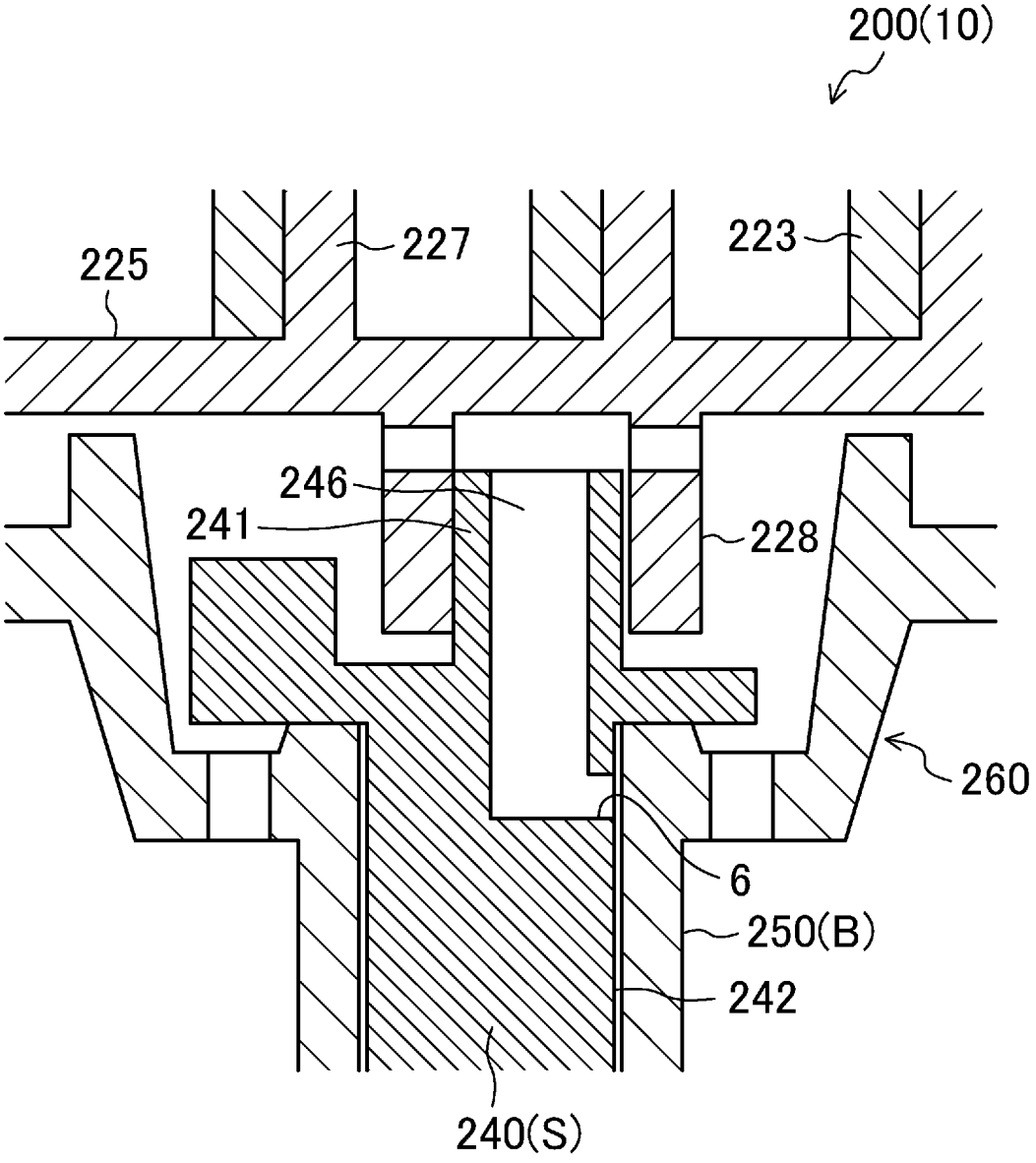
FIG. 17 is a partial cross-sectional view of a scroll compressor according to a first variation of the fifth embodiment.

As shown in FIG. 17, in the first variation of the fifth embodiment, the shaft side oil groove portion (6) of the scroll compressor (200) supplies lubricant between the main shaft portion of the drive shaft (240) and the bearing portion (250) of the housing (260). The scroll compressor (200) in the first variation is different in detail from that in the fifth embodiment of FIG. 16. However, they are identical to each other in basic configuration. Hence, a detailed description of the above scroll compressor will be omitted.

In this first variation of the fifth embodiment, an upper end face of the drive shaft (240)(S) is provided with an oil sump (246) having a circular cross section and extending from the upper end face of the eccentric portion (241) over the lower end of the eccentric portion (241) and reaching the main shaft portion. The main shaft portion of the drive shaft (240) is provided with a shaft side oil groove portion (6) communicating with this oil sump (246) and opening to an outer peripheral surface of the main shaft portion (242).

This shaft side oil groove portion (6) is configured such that a part of the engagement portion thereof engaging with the bearing portion (250) of the housing (260) stores the lubricant.

In the above configuration, when this scroll compressor (200) is operated under a high load or at a high rpm, in case of inclination of the drive shaft (240) (S), the lubricant stored in the shaft side oil groove portion (6) is supplied between the main shaft portion of the drive shaft (240) and the bearing portion (250) so that an oil coating sufficient for prevention of seizing is formed. As a result, the main shaft portion of the drive shaft (240) and bearing portion (250) come into surface-to-surface contact with each other with the oil coating provided therebetween. In this way, a partial contact between the main shaft portion of the drive shaft (240) and the bearing portion (250) is less likely to occur, resulting in suppression of rise in temperature. When the scroll compressor (200) is restarted after prolonged stop, a partial contact occurs in a conventional configuration before lubricant is supplied to a sliding portion, resulting in that metals of corresponding parts intensively contact each other. On the contrary, in this first variation of the fifth embodiment, such intensive contact between the metals of the corresponding parts can be avoided, since the oil is stored in the shaft side oil groove portion (6), thereby suppressing rise in temperature.

Therefore, even when the scroll compressor (200) is operated under a high load or at a high rpm, it is possible to prevent resulting rapid local temperature rise of the bearing portion (250). As a result, in the scroll compressor (200)

using a refrigerant prone to disproportionation, through a simple configuration, it is possible to suppress a partial contact of the bearing portion (250) and resulting rise in temperature of the refrigerant, thereby preventing the disproportional reaction of the refrigerant.

<Second Variation>

Figure 18:
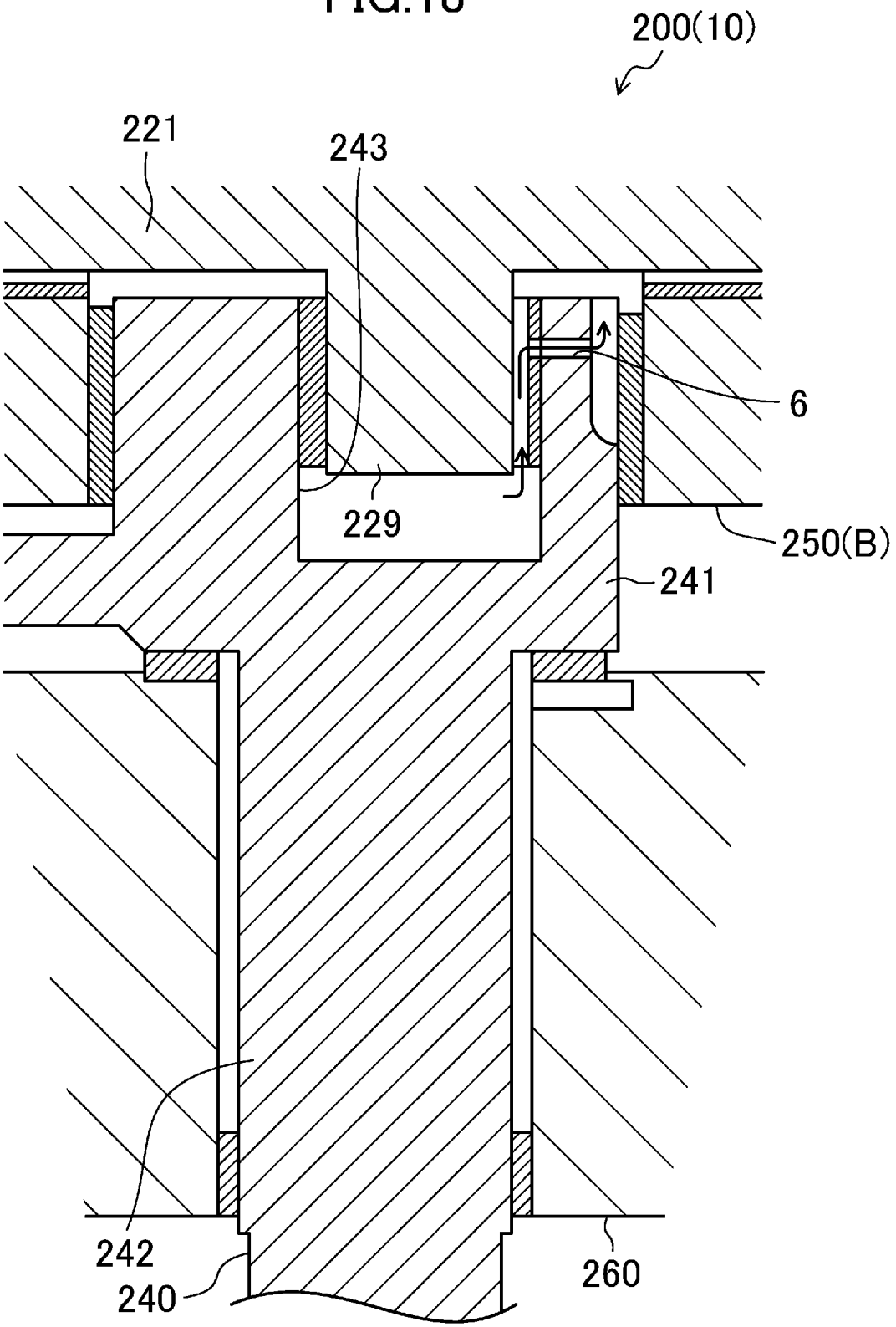
FIG. 18 is a partial cross-sectional view of a scroll compressor according to a second variation of the fifth embodiment.
Figure 19:
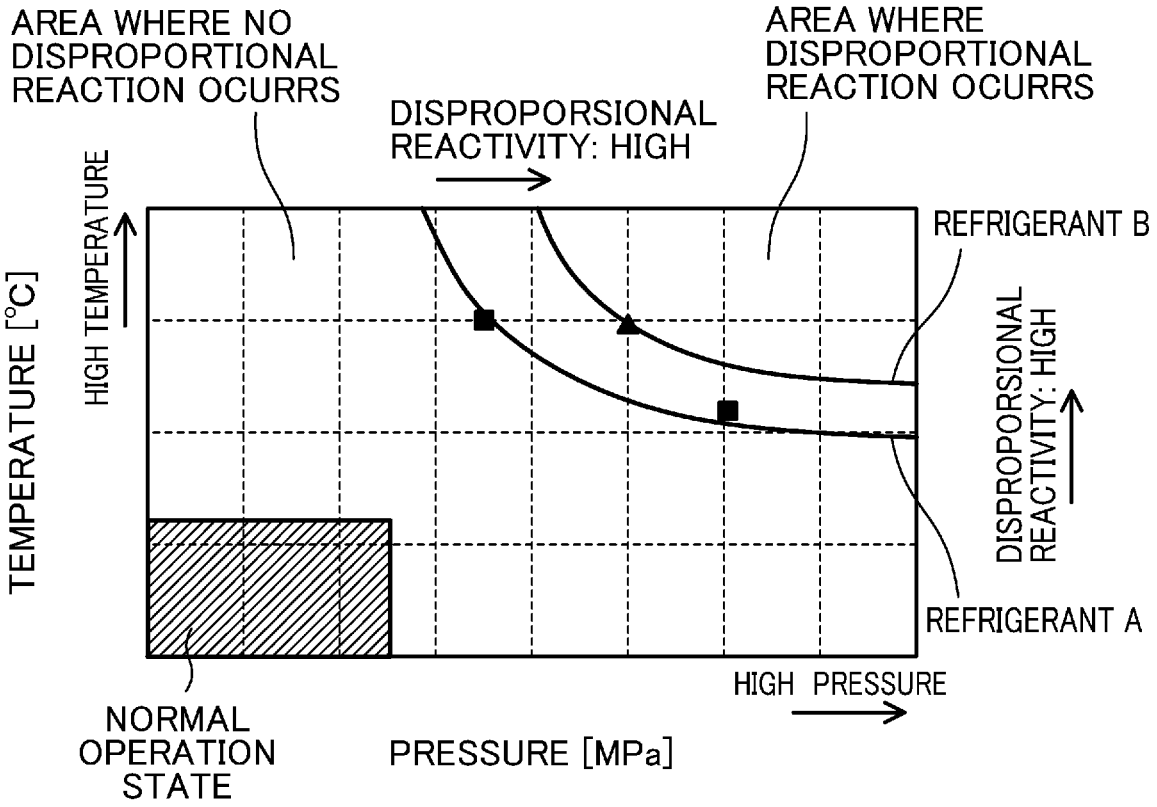
FIG. 19 is a graph showing reaction tendency of refrigerants prone to disproportionation.
Figure 20:
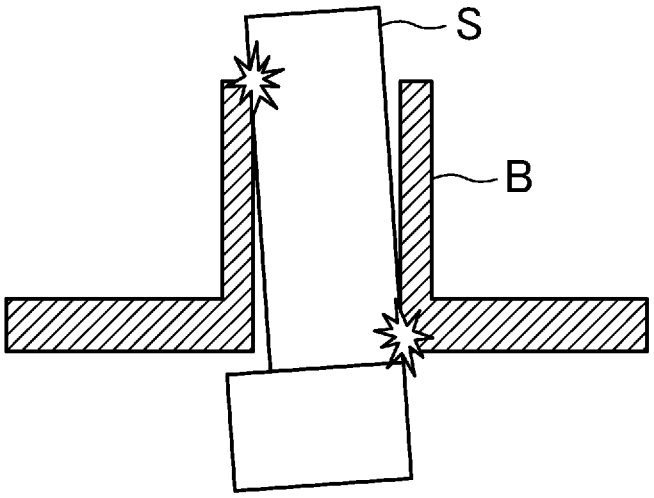
FIG. 20 is a rough cross-sectional view of a bearing structure of a conventional compressor.

As shown in FIG. 18, in the second variation of the fifth embodiment, the shaft side oil groove portion (6) of the scroll compressor (200) supplies lubricant to a sliding portion between the eccentric portion (241) of the drive shaft (240)(S) and the bearing portion (250). In this scroll compressor (200), the upper end of the drive shaft (240) is provided with an eccentric portion (241) with a diameter larger than that of the main shaft portion (242). An eccentric hole (243) formed in the eccentric portion (241) rotatably supports a pin shaft (229) of the movable scroll (225). The eccentric portion (241) of the drive shaft (240) is rotatably supported by the bearing portion (250).

The eccentric hole (243) formed to support the pin shaft on the upper end of the drive shaft (240) is a hole whose bottom surface is located at a position lower than an tip (lower end) of the pin shaft. This eccentric hole (243) constitutes an oil sump. The part with larger diameter is provided with a shaft side oil groove portion (6) communicating with this oil sump and opening to an outer peripheral surface of the eccentric portion (241).

This shaft side oil groove portion (6) is configured such that a part of the engagement portion thereof engaging with the bearing portion (250) of the housing (260) stores lubricant.

In the above configuration, when this compressor is operated under a high load or at a high rpm, in case of inclination of the drive shaft (240), the lubricant stored in the shaft side oil groove portion (6) is supplied between the eccentric portion (241) of the drive shaft (240) and the bearing portion (250) so that an oil coating sufficient for prevention of seizing is formed. As a result, the eccentric portion (241) of the drive shaft (240) and the bearing portion (250) come into surface-to-surface contact with each other with the oil coating provided therebetween. In this way, a partial contact between the eccentric portion (241) of the drive shaft (240) and the bearing portion (250) is less likely to occur, resulting in suppression of rise in temperature. When the scroll compressor (200) is restarted after prolonged stop, a partial contact occurs in a conventional configuration before lubricant is supplied to a sliding portion, resulting in that metals of corresponding parts intensively contact each other. On the contrary, in this second variation of the fifth embodiment, such intensive contact between the metals of the corresponding parts can be avoided, since the oil is stored in the shaft side oil groove portion (6), thereby suppressing rise in temperature.

Therefore, even when the scroll compressor (200) is operated under a high load or at a high rpm, it is possible to prevent resulting rapid local temperature rise of the bearing portion (250). As a result, in the scroll compressor (200) using a refrigerant prone to disproportionation, through a simple configuration, it is possible to suppress a partial contact of the bearing portion (250) and resulting rise in temperature of the refrigerant, thereby preventing the disproportional reaction of the refrigerant.

Another Embodiment

The above-described embodiments may be modified as follows.

The above embodiments include examples for applying the bearing structure of the present disclosure to the swing piston type compressor, the scroll type compressor and the reciprocation type compressor. This bearing structure may also be applied to other types of compressors such as a rolling piston type compressor.

Note that the foregoing description of the embodiments is a merely preferred example in nature, and is not intended to limit the scope, application, or uses of the present disclosure.

INDUSTRIAL APPLICABILITY

As described above, the present disclosure is useful in a compressor compressing a refrigerant including hydrocarbon fluoride prone to disproportionation where heat generation is suppressed to prevent disproportional reaction.

DESCRIPTION OF REFERENCE CHARACTERS

1 Heat Generation Suppression Portion
2 Elastic Bearing Portion
3 Shaft Side Crowning Portion
4 Bearing Side Crowning Portion
5 Bearing Side Oil Groove Portion
6 Shaft Side Oil Groove Portion
10 Compressor
11 Casing
12 Compression Mechanism
13 Electric Motor
B Bearing Portion
S Drive Shaft

The invention claimed is:

1. A compressor compressing a refrigerant including hydrocarbon fluoride prone to disproportionation, the compressor comprising:

a casing;

a compression mechanism housed in the casing, the compression mechanism having a fixed scroll, fixed to the casing, and a movable scroll;

an electric motor driving the compression mechanism;

a drive shaft connecting the compression mechanism with the electric motor, the drive shaft having a main shaft portion, and an eccentric shaft portion, to which the movable scroll is attached;

a bearing portion rotatably supporting the drive shaft; and a heat generation suppression portion formed on a contact portion of the drive shaft and the bearing portion, the heat generation suppression portion suppressing excessive heat generation due to line contact of an end edge portion of the bearing portion with the drive shaft during rotation of the drive shaft, the drive shaft being provided with an oil sump having an inverted U-shape in cross-section along a longitudinal direction of the drive shaft, and defining an annular space inside the eccentric shaft portion of the drive shaft to store lubricant, the eccentric shaft portion of the drive shaft being provided with a shaft side oil groove portion configured to communicate with the oil sump and store lubricant on a part of an engagement portion engaging with the bearing portion, and the heat generation suppression portion including the oil sump and the shaft side oil groove portion.

2. The compressor of claim 1, wherein
the refrigerant is a refrigerant comprising HFO-1123.

3. The compressor of claim 1, wherein
the oil sump is provided inside the eccentric shaft portion of the drive shaft, and extends along a rotational axis of the drive shaft.

4. The compressor of claim 1, wherein
the oil sump extends along a rotational axis of the drive shaft.

5. The compressor of claim 1, wherein
the oil sump is provided only inside the eccentric shaft portion of the drive shaft.

6. The compressor of claim 1, wherein
the oil groove portion is provided only in the eccentric shaft portion of the drive shaft.

* * * * *